US007199332B2

(12) United States Patent
Kagawa et al.

(10) Patent No.: US 7,199,332 B2
(45) Date of Patent: Apr. 3, 2007

(54) HEATING DEVICE AND IMAGE FORMING DEVICE

(75) Inventors: Toshiaki Kagawa, Nara (JP); Hiroshi Kida, Yamatokoriyama (JP); Takashi Yamanaka, Yamatokoriyama (JP); Tetsunori Mitsuoka, Tondabayashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/567,791

(22) PCT Filed: Aug. 10, 2004

(86) PCT No.: PCT/JP2004/011459

§ 371 (c)(1),
(2), (4) Date: Feb. 9, 2006

(87) PCT Pub. No.: WO2005/015320

PCT Pub. Date: Feb. 17, 2005

(65) Prior Publication Data

US 2006/0237417 A1 Oct. 26, 2006

(30) Foreign Application Priority Data

Aug. 12, 2003 (JP) ..... 2003-292501

(51) Int. Cl.
*G03G 15/20* (2006.01)
*H05B 3/02* (2006.01)

(52) U.S. Cl. ..... 219/216; 399/334

(58) Field of Classification Search ..... None
See application file for complete search history.

(56) References Cited

U.S. PATENT DOCUMENTS 5,671,462 A * 9/1997 Toyohara et al. ..... 399/330
5,819,134 A * 10/1998 Sato et al. ..... 399/330
5,961,864 A * 10/1999 Nakajima et al. ..... 219/216
6,697,597 B2 * 2/2004 Senda ..... 399/330
6,810,220 B2 * 10/2004 Hamada et al. ..... 219/216

FOREIGN PATENT DOCUMENTS

| | | | |
|---|---|---|---|
| JP | 6-19362 | A | 1/1994 |
| JP | 7-92852 | A | 4/1995 |
| JP | 8-220930 | A | 8/1996 |
| JP | 2001-154521 | A | 6/2001 |
| JP | 2002-258646 | A | 9/2002 |
| JP | 2002-268421 | A | 9/2002 |
| JP | 2002-357977 | A | 12/2002 |

* cited by examiner

*Primary Examiner*—Joseph Pelham
(74) *Attorney, Agent, or Firm*—Birch, Stewart, Kolasch & Birch, LLP

(57) ABSTRACT

Within a fixing roller (231) are disposed a main heater lamp (234*a*) for heating a central portion of the fixing roller and a sub-heater lamp (235*a*) for heating opposite end portions of the fixing roller. MRnh, SRnh and ΣRnh satisfy the formula (1) or (2):

$$\Sigma Rnh \geqq 30.5 \cdot Ln(Ht) + 382 \quad \text{formula (1)}$$

$$MRnh \leqq -21.9 \cdot Ln(Ht) - 198, \quad \text{formula (2)}$$

where MRnh is a mean value of heat distribution in a no-heat generating section of the main heater lamp; SRnh is a mean value of heat distribution in the a no-heat generating section of the sub-heater lamp; ΣRnh is the sum total of these mean values; and Ht=vp/(Mh·λ) where vp is a fixing speed (m/s), Mh a heat capacity per unit length of the heating member (J/(° C.·m)) and λ a heat conductivity of a material forming the heating member (W/(m·° C.)).

8 Claims, 24 Drawing Sheets

HEATING DEVICE AND IMAGE FORMING DEVICE

TECHNICAL FIELD

The present invention relates to a heating device for suitable use in such devices as a fixing device of a dry electrophotographic apparatus, a drying device of a wet electrophotographic apparatus, a drying device of an ink-jet printer, and an erasing device for rewritable media, and to an image forming apparatus.

BACKGROUND ART

Conventionally, a fixing device, which is one of representative heating devices for use in such electrophotographic apparatus as a copying machine and a printer, generally and often has a configuration wherein heating means comprising a halogen heater or the like is disposed inside a fixing roller comprising a hollow core of aluminum or the like and the fixing device is heated to a predetermined temperature (fixing temperature) by causing the halogen heater to generate heat.

This configuration, however, involves a problem that a length of time from the start of heating until the temperature of the fixing roller reaches the predetermined fixing temperature, which is so-called warm-up time, is long and, hence, the fixing roller need be preheated even during standby for the purpose of improving ease of use, thus resulting in increased power consumption during standby.

To overcome this problem, attempts have recently been made to thin the wall of the fixing roller by using an iron material having a superior strength to aluminum for the fixing roller in order to lower the heat capacity of the fixing roller, thereby to shorten the warm-up time. In this case, however, the fixing roller has a lowered heat flow along the axis thereof, thus raising a problem that what is called "abnormal temperature rise at a sheet non-passage portion", which is a phenomenon that if recording sheets of a size smaller than the fixing roller length pass through the fixing roller successively then the surface temperature of the fixing roller in a portion over which the recording sheets do not pass (sheet non-passage portion) rises abnormally, becomes easy to occur.

To solve such a problem, such a fixing device has been proposed that plural (mostly two) heaters for different heating regions are used to heat the different heating regions of the fixing roller selectively in accordance with the size of a recording sheet used (see patent document 1 for example).

Such a heating system employing plural heaters is basically classified into the following two types. The first type comprises a combination of a heater 234*a* for heating a central region and a heater 235*c* for heating the entire width region, as shown in FIG. 24(*a*). When a large-sized recording sheet is to pass through the fixing roller, only the entire width region heater 234*c* is actuated for heating. On the other hand, when a small-sized recording sheet is to pass through the fixing roller, only the central region heater 234*a* is actuated for heating.

In the first type system, however, end portions of the fixing roller 231 are not supplied with heat during successive passage of small-sized recording sheets and, hence, the temperature thereof is lower than that of the central portion. For this reason, if a large-sized recording sheet is passed immediately after passage of small-sized recording sheets, a problem of unsatisfactory fixing performance arises due to a fixing failure, wrinkling, curling or the like, which occurs in edge portions of the recording sheet.

The second type system performs heating by means of a heater (main heater) 234*a* for heating a central portion and a heater (sub-heater) 235*a* for heading end portions, as shown in FIG. 24(*b*). In this case, one temperature sensor 237 and one temperature sensor 238 are provided at the central portion and one end portion, respectively. The main heater 234*a* and the sub-heater 235*a* are each controlled based on a temperature detected by a respective one of the sensor 237 at the central portion and the sensor 238 at the end portion.

The second type system is capable of exhibiting satisfactory fixing performance even upon passage of a large-sized recording sheet immediately after passage of small-sized recording sheets without experiencing the aforementioned temperature drop at the end portions by controlling the temperature of the end portions of the fixing roller 231 to an appropriate temperature by means of the sub-heater 235*a* even during the passage of small-sized recording sheets.

Further, a method in relation to the second type system has been proposed such that a shortcircuiting stem is inserted into a filament coil in a no-heat generating section of each heater to prevent the no-heat generating section from generating heat, thereby further suppressing the abnormal temperature rise at the sheet non-passage portion during successive passage of small-sized recording sheets (see patent document 2 for example). Hereinafter, a heater lamp used in this type will be referred to as a partial lamp while a heater lamp used in the conventional type referred to as a normal lamp.

Table 1 and FIGS. 12 and 13 show the results of comparison between the case where normal lamps were used for both of the main heater and the sub-heater in a high-speed multifunctional machine having a printing speed of 70 cpm (pattern 1) and the case where partial lamps were used for both of the main heater and the sub-heater (pattern 8) as to temperature distribution along the axis of the fixing roller immediately after successive passage of 100 A4- or B5R-size recording sheets. In Table 1, MRnh represents a mean value of heat distribution in the no-heat generating section of the main heater and SRnh represents a mean value of heat distribution in the no-heat generating section of the sub-heater.

TABLE 1

| | | Pattern 1 | Pattern 2 | Pattern 3 | Pattern 4 | Pattern 5 | Pattern 6 | Pattern 7 | Pattern 8 |
|---|---|---|---|---|---|---|---|---|---|
| Main Heater | Type | Normal A | Normal B | Normal C | Normal B | Partial A | Normal C | Partial B | Partial A |
| | MRnh (%) | 48.0 | 35.9 | 30.5 | 35.9 | 13.1 | 30.5 | 26.3 | 13.1 |
| Sub Heater | Type | Normal | Normal | Normal | Partial | Normal | Partial | Partial | Partial |
| | SRnh (%) | 36.5 | 36.5 | 36.5 | 14.2 | 36.5 | 14.2 | 14.2 | 14.2 |
| Σ Rnh (%) | | 84.5 | 72.3 | 67.0 | 50.1 | 49.5 | 44.7 | 40.5 | 27.2 |

Heat distributions of respective heater lamps are shown in FIGS. 9 to 11 and Table 1 in which "normal A" of FIG. 9 and "normal" of FIG. 11 correspond to the main heater and the sub-heater, respectively, of pattern 1 while "partial A" of FIG. 10 and "partial" of FIG. 11 correspond to the main heater and the sub-heater, respectively, of pattern 8.

As can be seen from FIGS. 12 and 13, the temperature uniformity obtained with respect to moderate A4-size sheets in the case where partial lamps were used for heater lamps (pattern 8) was comparable to that obtained in pattern 1 employing conventional normal type lamps, and pattern 8 substantially reduced the temperature rise at the sheet non-passage portion with respect to small B5R-size recording sheets as compared with pattern 1.

Patent Document 1: JP H8-220930A (paragraphs [0017] and [0018], FIGS. 1 and 2)

Patent Document 2: JP 2002-258646A (paragraphs [0015] to [0021], FIGS. 1 and 2)

DISCLOSURE OF THE INVENTION

Problems to be Solved by the Invention

However, the inventors of the present invention have found out a problem that, in the case where partial lamps are used as heater lamps, variation in fixing roller temperature increases undesirably due to variation in the heat distributions of the heater lamps. This problem will be described below.

As shown in FIGS. 9 to 11, the heater lamps are each manufactured so as to provide a predetermined heat distribution. Each of heater lamps manufactured in volume production may provide a heat distribution deviated to a maximum of about 5 mm from a designed value due to variation in positioning the filament during manufacture, variation in the precision with which the heater lamps are mounted in the fixing unit, and the like.

Specifically, in cases where two types of heater lamps, i.e., main heater and sub-heater, are used as in pattern 8, if the heat distributions of the main heater and sub-heater are deviated to a maximum of 5 mm in opposite directions, there is a relative deviation of 10 mm from one heat distribution to the other.

The results of examination of the variation in the temperature of a fixing roller caused by such a deviation through an experiment using multifunctional machines of different printing speeds (70 cpm, 45 cpm and 26 cpm) are shown in Table 2 and FIGS. 14 and 15. Here, four different types (in material) of fixing rollers were used as seen from Table 2.

TABLE 2

| | Print Speed (cpm) | | | | | | | |
|---|---|---|---|---|---|---|---|---|
| | 70 | | | | 45 | | | |
| | Fixing Speed vp (mm/s) | | | | | | | |
| | 395 | | | | 225 | | | |
| | Material | | | | | | | |
| | Iron | Iron | Iron | Aluminum | Iron | Iron | Iron | Aluminum |
| Heat Conductivity λ (W/m° C.) | 45 | 45 | 45 | 206 | 45 | 45 | 45 | 206 |
| Wall Thickness t (mm) | 0.70 | 1.30 | 2.20 | 1.50 | 0.40 | 0.80 | 1.22 | 0.83 |
| Outer Diameter D (mm) | 40 | 40 | 40 | 40 | 40 | 40 | 40 | 40 |
| Length L (mm) | 316 | 316 | 316 | 316 | 316 | 316 | 316 | 316 |
| Heat Capacity per Unit Length Mh (J/° C. · m) | 310 | 567 | 937 | 460 | 179 | 332 | 533 | 259 |
| Temperature Variation Index Ht ($m^3/J^2$) | 2.8E-05 | 1.5E-05 | 9.4E-06 | 4.2E-06 | 2.8E-05 | 1.5E-05 | 9.4E-06 | 4.2E-06 |
| Temperature Variation ΔTr (deg) | 43.7 | 33.4 | 25.0 | 17.5 | 41.7 | 32.6 | 26.2 | 16.8 |

| | Print Speed (cpm) | | | |
|---|---|---|---|---|
| | 26 | | | |
| | Fixing Speed vp (mm/s) | | | |
| | 122 | | | |
| | Material | | | |
| | Iron | Iron | Iron | Aluminum |
| Heat Conductivity λ (W/m° C.) | 45 | 45 | 45 | 206 |
| Wall Thickness t (mm) | 0.29 | 0.55 | 0.88 | 0.60 |
| Outer Diameter D (mm) | 30 | 30 | 30 | 30 |
| Length L (mm) | 316 | 316 | 316 | 316 |
| Heat Capacity per Unit Length | 97 | 183 | 289 | 141 |

TABLE 2-continued

| | | | | |
|---|---|---|---|---|
| Mh (J/° C. · m) | | | | |
| Temperature Variation Index Ht ($m^3/J^2$) | 2.8E-05 | 1.5E-05 | 9.4E-06 | 4.2E-06 |
| Temperature Variation ΔTr (deg) | 39.9 | 32.8 | 27.6 | 16.7 |

Partial lamps were used for both of the main heater lamp and sub-heater lamp of pattern 8. The heat distribution of the main lamp was established to deviate 5 mm toward the minus side (left-hand side) from the sheet passage reference position (on a center registration basis), while the heat distribution of the sub-lamp established to deviate 5 mm toward the plus side (right-hand side) from the sheet passage reference position (on the center registration basis).

The experiment was conducted according to a method wherein: 100 A4-size recording sheets were successively passed as aligned with the sheet passage reference position on the center registration basis with the fixing roller under temperature control at a fixing temperature meeting a respective one of the printing speeds (at 210° C., 180° C. and 170° C. meeting a respective one of the printing speeds of 70 cpm, 45 cpm and 26 cpm); and the temperature distribution along the axis of the fixing roller obtained after the passage of the 100 recording sheets was determined using a two-dimensional radiation thermometer.

FIG. 14 is a chart showing the temperature distributions each obtained axially of a respective one of the different fixing rollers when the printing speed was 70 cpm. As can be seen from FIG. 14, with the heat distribution deviated as mentioned above, the temperature distributions of respective fixing rollers were obtained in each of which the temperature was higher than the controlled temperature of 210° on the minus side and lower than the controlled temperature on the plus side with a temperature variation ΔTr.

As can be further seen, in the case where the fixing rollers were formed from the same material, the fixing roller temperature variation ΔTr became more conspicuous with decreasing fixing roller wall thickness (=heat capacity). The heat capacity per unit length Mh(J/(° C.·m)) of a fixing roller is expressed by the formula (11):

$$Mh=Ch\cdot Cw\cdot\pi\{(D/2)^2-(D/2-2t)^2\} \qquad \text{formula (11)}$$

where t(mm), D(mm), Ch(J/(g° C.) and Cw(g/$cm^3$) represent the wall thickness, outside diameter, specific heat and specific gravity, respectively, of the fixing roller.

Since the temperature variation ΔTr along the axis of a fixing roller is considered to become more conspicuous as the heat capacity Mh(J/(° C.·m)) or heat conductivity λ(W/(m·° C.)) of the fixing roller decreases or as the fixing speed Vp(m/s) increases, an index indicative of the temperature variation along the axis of the fixing roller is defined by the formula (12):

$$Ht=vp/(Mh\cdot\lambda) \qquad \text{formula (12).}$$

The relationship between Ht and ΔTr was determined and the results of the determination were as shown in FIG. 15.

According to the determination, ΔTr and Ht have, regardless of the fixing speed, the relationship expressed by the formula (13):

$$\Delta Tr=13Ln(Ht)+178 \qquad \text{formula (13)}$$

where Ln is a natural logarithm.

Since the relationship is expressed by the approximate expression of the formula (13), Ht can be used as the index for examining ΔTr throughout every speed region regardless of the fixing speed. If cases where the fixing speed is 70 cpm are examined as representative cases to determine the relationship with Ht, the relationship thus determined can be applied to a fixing device of any fixing speed.

In a common fixing device, temperature variation factors include, besides the temperature variation ΔTr(deg) along the fixing roller axis, a temperature ripple ΔTc(deg) along the fixing roller circumference ascribed to temperature control precision, a temperature variation ΔTs(deg) due to the difference between individual temperature sensors, and like factors. Establishment need be made so that these factors fall within a toner non-offset region ΔTo(deg).

That is, $$\Delta To\geqq\Delta Tr+\Delta Tc+\Delta Ts$$

$$\therefore\Delta Tr\leqq\Delta To-\Delta Tc-\Delta Ts \qquad \text{formula (14).}$$

Since ΔTo≈40, ΔTc≈10, and ΔTs≈5 under normal circumstances, it follows that:

$$\Delta Tr\leqq 25 \qquad \text{formula (15).}$$

The temperature variation ΔTr along the fixing roller axis needs to satisfy the above-noted formulae (14) and (15).

As can be understood from FIG. 15, if a low-heat-capacity type fixing roller having Ht of not less than $7.74\times10^{-6}$ is used in a system of the type employing partial lamps like pattern 8 in order to shorten the warm-up time, ΔTr becomes larger than 25 deg, thus causing an offset to occur.

The present invention has been made in view of such circumstances. Accordingly, it is an object of the present invention to provide a heating device wherein the temperature distribution is rendered uniform along the axis of a heating member having a thin wall and a low heat capacity and comprising plural heating means thereby improving the heat efficiency of the heating device, as well as an image forming apparatus provided with the heating device.

Solution

A heating device according to the present invention comprises:

a cylindrical heating member configured to heat and fix a toner image carried on a recording sheet brought into contact with a periphery of the heating member by rotation;

a first heating unit disposed within the heating member and having a first heat generating section including a heating generating portion facing a central portion of the recording sheet, and a first no-heat generating section continuous with the first heat generating section; and a second heating unit disposed within the heating member and having a second no-heat generating section opposed to the first heat generating section, and a second heat generating section opposed to the first no-heat generating section, wherein assuming that: a mean value of heat distribution in the first no-heat generating section of the first heating unit is MRnh; a mean value of heat distribution in the second no-heat generating section of the second heating unit is SRnh; and the sum total of the means value of heat distribution in the first no-heat generation section and the means value of heat distribution in second no-heat generating section is ΣRnh(=MRnh+SRnh), MRnh, SRnh and ΣRnh satisfy the formula (1):

$$\Sigma Rnh \geqq 30.5 \cdot Ln(Ht)+382 \quad \text{formula (1),}$$

provided Ht=vp/(Mh·λ) where vp is a fixing speed (m/s), Mh a heat capacity per unit length of the heating member (J/(° C.·m)) and λ a heat conductivity of a material forming the heating member (W/(m·° C.)). In the formula (1), Ln is a natural logarithm (hereinafter the same).

According to an experiment, in the case where the heating member comprises a thin wall material and has a small heat capacity, if the sum total ΣRnh of means values of heat distributions in the no-heat generating sections of all the heating units is less than 30.5·Ln(Ht)+382, the temperature variation along the fixing roller axis, which occurs when the heat distribution along the axis of each heater lamp serving as a heating unit is deviated, becomes too large (not less than 25 deg), thus causing a high-temperature offset, paper wrinkling or the like to occur. Incidentally, since the first heating unit including the heat generating section positioned to face the central portion of a recording sheet is heated constantly irrespective of the size of the recording sheet, the first heating unit will hereinafter be referred to as "main heating unit" as the case may be. Also, the second heating unit, which is continuous with the first heating unit, will be hereinafter referred to as "sub-heating unit" as the case may be. The sub-heating unit is configured to heat edge portions of a recording sheet optionally depending on the recording sheet size.

With this construction, the temperature variation along the fixing roller axis, which occurs when the heat distribution along the axis of each heater lamp is deviated, can be reduced to 25 deg or less by establishing the heat distributions (relative values) of the heater lamps serving as the heating units to satisfy the above-noted formula (1).

To realize such heat distributions, use is simply made of a heater lamp of the so-called partial type having a short-circuiting stem inserted into the filament coil in its no-heat generating section as the heater lamp of only one of the first and second heating units (main heating unit and sub-heating unit) for example.

In another embodiment of the present invention, assuming that the mean value of heat distribution in the first no-heat generating section of the first heating unit is MRnh, MRnh satisfies the formula (2):

$$MRnh \leqq -21.9 \cdot Ln(Ht)-198 \quad \text{formula (2).}$$

According to the experiment, in the case where the heating member comprises a thin wall material and has a small heat capacity, if the mean value MRnh of heat distribution in the first no-heat generating section of the first heating unit (main heating unit) is more than −21.9·Ln(Ht)−198, the temperature rise at the sheet non-passage portion of the fixing roller, which occurs when small-sized recording sheets are passed through the fixing roller, becomes too large (not less than 25 deg), thus causing high-temperature offset, paper wrinkling or the like to occur.

With this feature, it is possible to prevent positional deviation of the heat distributions of the heating units and reduce the abnormal temperature rise at the sheet non-passage portion of the fixing roller, which occurs when small-sized recording sheets are passed through the fixing roller, to 25 deg or less by establishing the heat distributions (relative values) of the heater lamps serving as the heating units to satisfy the above-noted formula (2).

To realize such heat distributions, use is simply made of a heater lamp of the so-called partial type having a short-circuiting stem inserted into the filament coil in its no-heat generating section as the heater lamp of only one of the first and second heating units (main heating unit and sub-heating unit) for example.

In yet another embodiment of the present invention, the above-noted formulae (1) and (2) are both satisfied.

With this feature, it is possible to prevent the heat distributions of the heating means from deviating and reduce the abnormal temperature rise at the sheet non-passage portion of the fixing roller, which occurs when small-sized recording sheets are passed through the fixing roller, more effectively.

In yet another embodiment of the present invention, the mean value SRnh of heat distribution in the second no-heat generating section of the second heating unit satisfies the formula (3):

$$SRnh \leqq 20\% \quad \text{formula (3).}$$

According to the experiment, in the case where the heating member comprises a thin wall material and has a small heat capacity, if the mean value SRnh of heat distribution in the second no-heat generating section of the second heating unit is more than 20%, a large difference in the power consumption of the first heating unit results between the case where a large-sized recording sheet is passed through the fixing roller and the case where a small-sized recording sheet is passed through the fixing roller. For this reason, the total rated power of the heating units need be set larger. This results in a problem that an apparatus of large power consumption, such as a high-speed apparatus, cannot ensure a satisfactory temperature follow-up capability during passage of a small-sized recording sheet, and a like problem.

Further, in the above-described case the power consumption of the first heating unit (main heating unit) varies largely due to the difference between recording sheet sizes, variation in heat distribution, or the like. A heater lamp is most efficient when it is used at a power close to the rated power. Under the aforementioned conditions, however, the heater lamp is used at a power considerably lower than the rated power in fixing an image to an A4-size sheet for example, which gives rise to problems including an increase in power consumption due to lowered thermal efficiency and a drop in fixing performance due to insufficient temperature follow-up capability.

With the above-described feature, it is possible to reduce the difference in the power consumption of the first heating unit (main heating unit) between the case where a large-sized recording sheet is passed through the fixing roller and the case where a small-sized recording sheet is passed through the fixing roller by establishing the heat distributions (relative values) of the heating units to satisfy the formula (3). Therefore, even an apparatus of large power consumption, such as a high-speed apparatus, can ensure a satisfactory temperature follow-up capability during passage of a small-sized recording sheet. Further, the difference in the power consumption of the first heating unit due to the difference between recording sheet sizes, variation in heat distribution or the like is relatively small, which allows the heater lamp to be used at a power close to the rated power.

In yet another embodiment of the present invention, the second no-heat generating section of the second heating unit includes a filament coil into which a shortcircuiting stem is inserted.

This feature can realize a stabilized heat distribution of the heating means which satisfies the formula (3) by using a heater lamp of the so-called partial type having the shortcircuiting stem inserted into the filament coil in its no-heat generating section as the heater lamp of only the second heating unit (sub-heating unit).

Yet another embodiment of the present invention satisfies the formula (4):

$$Ht \geqq 7.74\times10^{-6} \qquad \text{formula (4).}$$

If the heating member (fixing roller) having conventional heating units (heater lamps) in which ΣRnh is less than 30% satisfies the formula (4), the temperature variation due to the variation in heat distribution along the axis of each of the heater lamps becomes too large (not less than 25 deg) irrespective of the fixing speed. However, this embodiment prevents the occurrence of such a temperature variation since ΣRnh of the formula (1) is established to satisfy the formula (2).

In still yet another embodiment of the present invention, the heating member is a heating roller comprising a cylindrical core coated with a coat layer, the core being formed from an iron material.

If the heating member (fixing roller) having conventional heating means (heater lamps) in which ΣRnh is less than 30% satisfies the formula (4), the temperature variation due to the variation in heat distribution along the axis of each of the heater lamps becomes too large (not less than 25 deg) irrespective of the fixing speed. However, this embodiment in which the heating roller has a core formed from an iron material prevents the occurrence of such a temperature variation since ΣRnh of the formula (1) is established to satisfy the formula (2).

ADVANTAGE OF THE INVENTION

Even with a low-heat-capacity heating member comprising a thin wall material, it is possible to prevent positional deviation of heat distributions of the heating units.

Even when small-sized recording sheets are passed, the abnormal temperature rise at the sheet non-passage portion is suppressed and, hence, high-temperature offset, paper wrinkling and the like can be prevented from occurring.

Further, the rated power can be lowered and, hence, even an apparatus of large power consumption, such as a high-speed apparatus, can ensure a satisfactory temperature follow-up capability during passage of small-sized recording sheets. Furthermore, the variation in the power consumption of the main heating means due to the difference between recording sheet sizes, the variation in heat distribution or the like is relatively small, which allows the heating means to be used at a power close to the rated power.

DESCRIPTION OF THE REFERENCE NUMERALS

23 . . . heating device
231 . . . heating member
234, 235 . . . heating means
234*a*, 234*b* . . . main heating means
235*a*, 235*b* . . . sub-heating means

BEST MODE FOR CARRYING OUT THE INVENTION

Hereinafter, one embodiment in which a heating device according to the present invention is used for the fixing device of an image forming apparatus (electrophotographic apparatus) will be described with reference to the drawings.

Figure 1:
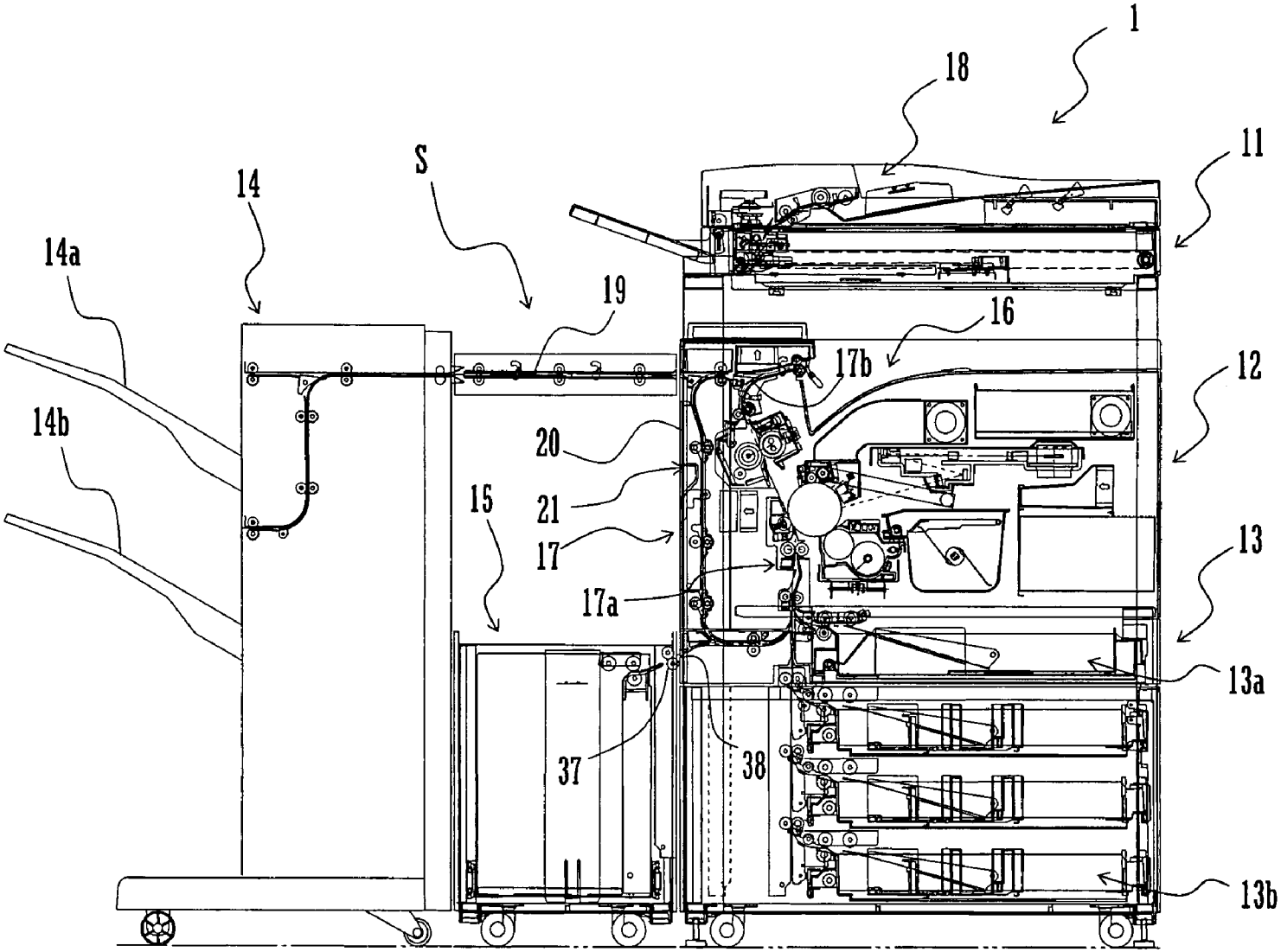
FIG. 1 is an explanatory view showing the construction of an image forming apparatus according to one embodiment of the present invention.

FIG. 1 is a sectional view showing the construction of an image forming apparatus 1. The image forming apparatus 1 includes a document image reader 11, an image recording device 12, a recording material feeder 13, a post-processing device 14, and an external recording material feeder 15. An image forming apparatus body 20, such as a digital printer, includes the image recording device 12 as an image forming section, the recording material feeder 13 as a recording material feeding section, and a transport section 17 for transporting a recording material from the recording material feeder 13 to a recording material delivery section 16 via the image recording device 12.

Description will be made of the operation of the image forming apparatus body 20. First, the document image reader 11 reads a document to obtain image data and outputs the image data to the image recording device 12. The image recording device 12 performs appropriate image processing on the image data inputted. The recording material feeder 13 feeds sheet-shaped recording materials (recording sheets, recording mediums and the like), such as printing sheets or OHP (Over Head Projector) sheets, one by one separately and then the transport section 17 transports such recording materials to the image recording device 12 through a first transport path 17*a*.

The image recording device 12 forms an image on a recording material based on the image data by printing or the like. The recording material printed with the image is transported to the recording material delivery section 16 through a second transport path 17*b* and then delivered to the outside of the apparatus.

The document image reader 11 is fitted with a document tray 18 serving as a document feeding section or a document collecting section. When serving as the document feeding section, the document tray 18 is capable of receiving a series of documents comprising plural pages thereon and feeding the documents thus received to a reading section successively while separating the documents one from another. When serving as the document collecting section, the document tray 18 receives and holds documents finished with reading and successively delivered.

If printed recording materials are delivered to the recording material delivery section 16 in printing plural copies of a series of documents read, mixed delivery, such as successive delivery of recording materials printed with the image of the same page, occurs and, hence, the user has to sort the recording materials after printing. In view of such an inconvenience, the post-processing device 14 is connected to the image forming apparatus body 20 so that recording materials can be delivered to, for example, plural delivery trays 14*a* and 14*b* in a sorted fashion to avoid such mixed delivery.

The image forming apparatus body 20 and the post-processing device 14 are spaced a predetermined distance from each other and, hence, a space S is defined therebetween. The image forming apparatus body 20 and the post-processing device 14 are interconnected via an external transport section 19. Thus, a recording material bearing an image printed thereon is transported from the transport section 17 to the post-processing device 14 via the external transport section 19.

From the viewpoints of energy saving and cost reduction, demand exists for the function of printing images on both sides of a recording material such as printing paper. This function can be implemented by a transport section 21 for double-side printing which is configured to turn a recording material printed with an image on one side thereof upside down and transport it to the image forming device 12 again.

Such a recording material printed on one side thereof is turned upside down and transported to the image recording device 12 again by means of the transport section 21 for double-side printing without being transported to either the recording material delivery section 16 or the post-processing device 14. The image recording device 12 prints an image on the blank side of the recording material to implement double-side printing.

When it is desired to feed recording materials that exceeds the number of types or the amount of recording materials that can be held by the recording material feeder 13, the external recording material feeder 15 as a peripheral device for extension is disposed within the space S and connected to the image forming apparatus body 20 to allow desired types and amount of recording materials to be held and fed thereby.

Figure 2:
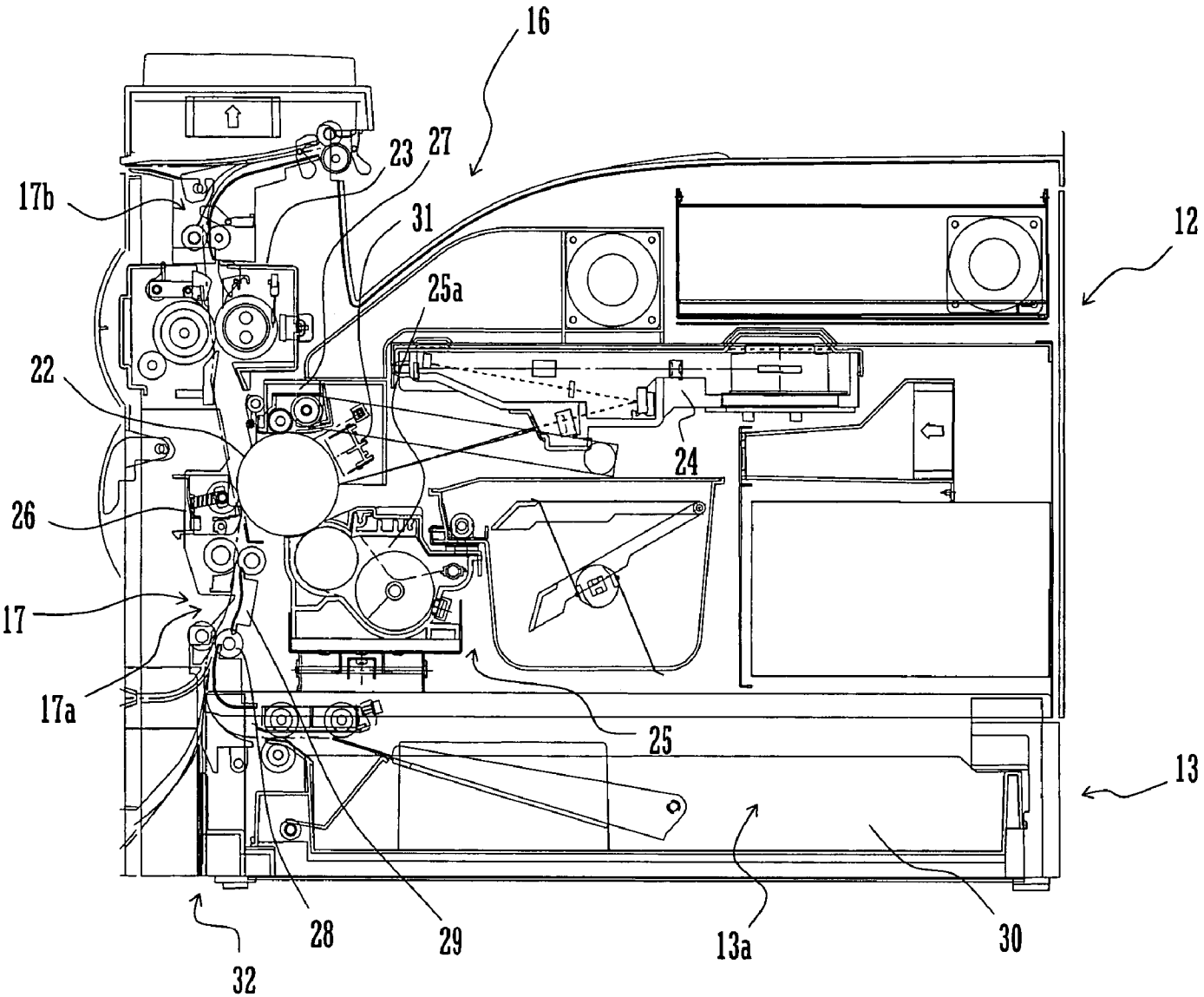
FIG. 2 is an explanatory view showing the construction of an image forming section.

Detailed description will be made of the construction of the image forming apparatus 1. FIG. 2 is a sectional view showing the construction of the image recording device 12. An electrophotographic processing section in which a photosensitive drum is centered is located on generally left-hand side of the center of the image recording device 12. About the photosensitive drum 22 there are disposed an electrostatic charger unit 31 for electrostatically charging the surface of the photosensitive drum 22 uniformly, an optical scanning unit 24 for applying a light image to the uniformly charged photosensitive drum 22 by scanning to write an electrostatic latent image thereon, a developing unit 25 for developing the electrostatic latent image thus written by the optical scanning unit 24 with use of developer, a transfer unit 26 for transferring the developed image recorded on the surface of the photosensitive drum 22 to a recording material, a cleaning unit for eliminating residual developer from the surface of the photosensitive drum 22 to enable a fresh image to be recorded on the photosensitive drum 22, and like components.

A fixing unit 23 is disposed above the electrophotographic processing section. The fixing unit 23 receives recording materials bearing respective images transferred thereto by the transfer unit 26 sequentially and fixes the developer transferred to each recording material by heating. Each recording material thus printed with the image is delivered to the recording material delivery section 16 located above the image recording device 12 with its printed side oriented down (face down). Residual developer eliminated by the cleaning unit 27 is collected and fed back to a developer feeding section 25*a* of the developing unit 25 for reuse.

Below the image recording device 12 is disposed the recording material feeding section 13*a* holding recording materials and fitted within the device. The recording material feeding section 13*a* feeds recording materials one by one separately to the electrophotographic processing section. The transport section 17 comprises plural rollers 28 and guides 29. Each recording material passes through the first transport path 17*a* defined between rollers, between guides, between the photosensitive drum 22 and the transfer unit 25, and by like components and then, after printing of an image, through the second transport path 17*b* defined between rollers and between guides and by the fixing unit 23 and the like.

In setting recording materials in the recording material feeding section 13*a*, a recording material tray 30 is drawn out in the direction perpendicular to the feed direction of the image recording device 12, i.e., toward the front side in the direction perpendicular to the FIG. 2 sheet face for supply or replacement of recording materials.

The underside of the image recording device 12 defines a recording material receiving section 32 for receiving recording materials fed from the recording material feeder 13*b* (see FIG. 1) as an add-on unit and feeding the recording materials sequentially to the space between the photosensitive drum 22 and the transfer unit 26.

In the space around the optical scanning unit 24 are disposed a process control unit (PCU) board for controlling the electrophotographic processing section, an interface board for receiving image data from the outside of the apparatus, an image control unit (ICU) board for performing predetermined image processing on image data received by the interface board or image data read by the document image reader 11 to allow the optical scanning unit to record such image data as an image by scanning, a power source unit for supplying electric power to these boards and units, and like components.

If connected to an external device such as a personal computer via the interface board, the image recording device 12 alone can operate as a printer operative to form an image on a recording material based on image data transmitted from the external device. Though the recording material feeding section 13*a* fitted within the image recording device 12 is single according to the above description, more than one recording material feeding sections can be fitted within the device.

Figure 3:
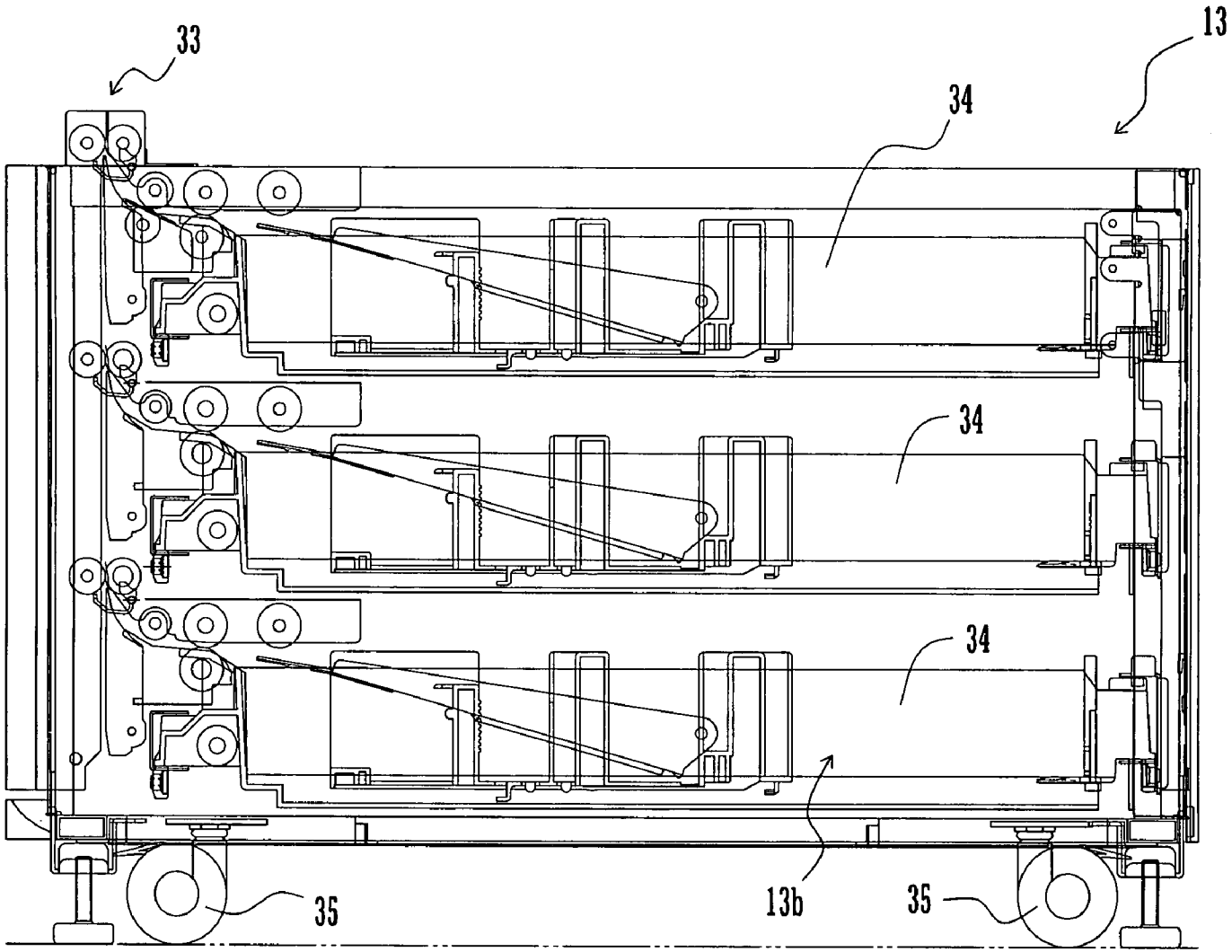
FIG. 3 is an explanatory view showing the construction of a recording material feeder.

FIG. 3 is a sectional view showing the construction of the recording material feeder 13*b* as an add-on unit. The recording material feeder 13*b* can be added on the image recording device 12 as a part of the image recording device 12 when the number of recording materials that can be fed by the recording material feeding section 13*a* is insufficient. The recording material feeder 13*b* is capable of holding recording materials that are larger in size than recording materials that can be held by the recording material feeding section 13*a*. The recording material feeder 13*b* feeds recording materials held therein to a recording material delivery section 33 provided on an upper side thereof while separating the recording materials one from another.

Recording material trays 34, which are stacked in three tiers, are selectively operated under control of a CPU or the like to separately feed desired recording materials held therein. Each recording material thus fed passes from the recording material delivery section 33 to the electrophotographic processing section through the recording material receiving section 32 located in a lower portion of the image recording device 12. In setting recording materials in the recording material feeder 13*b*, each recording material tray 34 is drawn out toward the front side of the recording material feeder 13*b* for supply or replacement of recording materials.

While the recording material feeder 13*b* includes three recording material trays 34 stacked in tiers according to the above description, the recording material feeder 13*b* may comprise at least one or more than three recording material trays 34 and the recording material delivery section 33. The recording material feeder 13*b* is provided on its underside a plurality of wheels 35 which enable the image forming apparatus body 20 including the recording material feeder 13*b* to move easily when the feeder 13*b* is added on or on like occasions. The image forming apparatus body 20 can be fixed to its installation site by means of a stopper 36.

Figure 4:
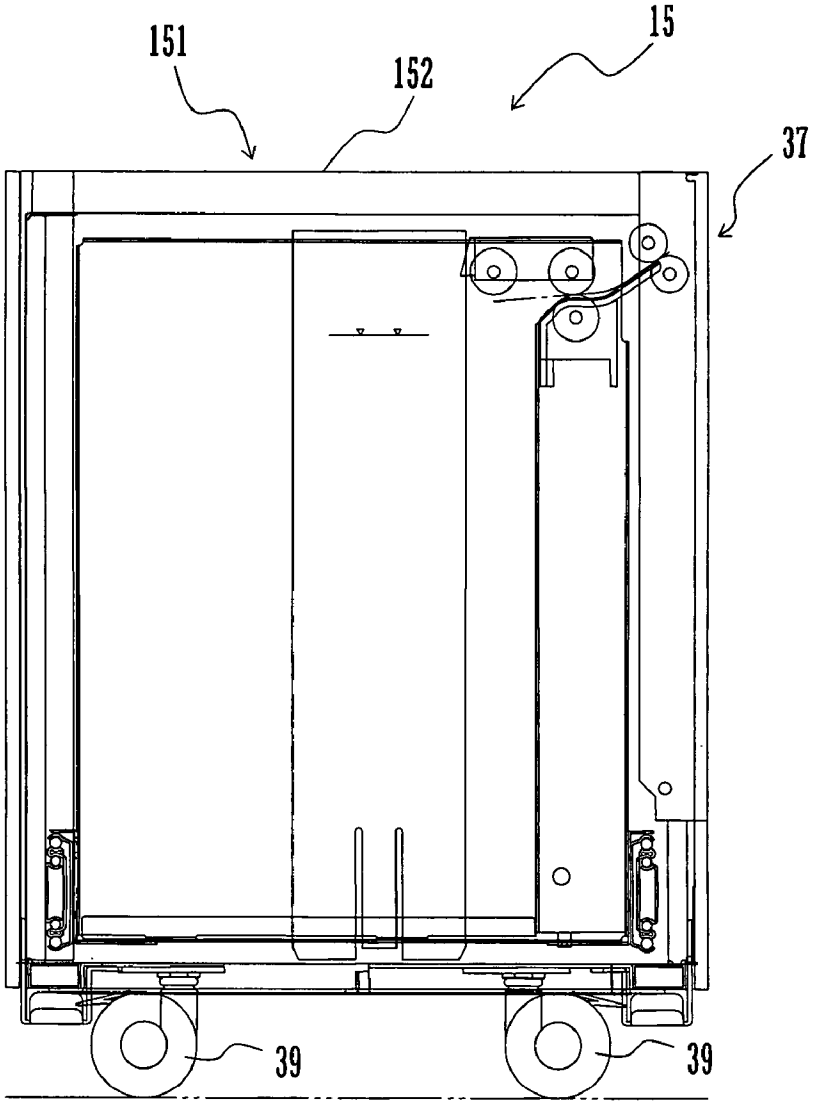
FIG. 4 is an explanatory view showing the construction of an external recording material feeder.

FIG. 4 is a sectional view showing the construction of the external recording material feeder 15. The external recording material feeder 15 is capable of holding recording materials that exceed the number of types and the amount of recording materials that can be held by the recording material feeders 13*a* and 13*b* included in the image recording device 12 and feeding the recording materials held therein one by one separately toward a recording material delivery section 37 located in an upper portion on the right-hand lateral side of the feeder. Each recording material delivered from the recording material delivery section 37 is received by an external recording material receiving section 38 (see FIG. 1) provided in a lower portion of the left-hand lateral side of the image recording device 12.

Recording materials are set in the external recording material feeder 15 through a supply port 151 defined in an upper portion of the external recording material feeder 15 upon supply or replacement of recording materials. The supply port 151 is provided with an openable cover 152 which may be configured to close the supply port 151 usually except upon supply or replacement of recording materials. The external recording material feeder 15 is provided on its underside a plurality of wheels 39 which enable the feeder 15 to move easily when the feeder 15 is to be added on or on like occasions. The external recording material feeder 15 can be fixed to its installation site by means of a stopper.

Figure 15:
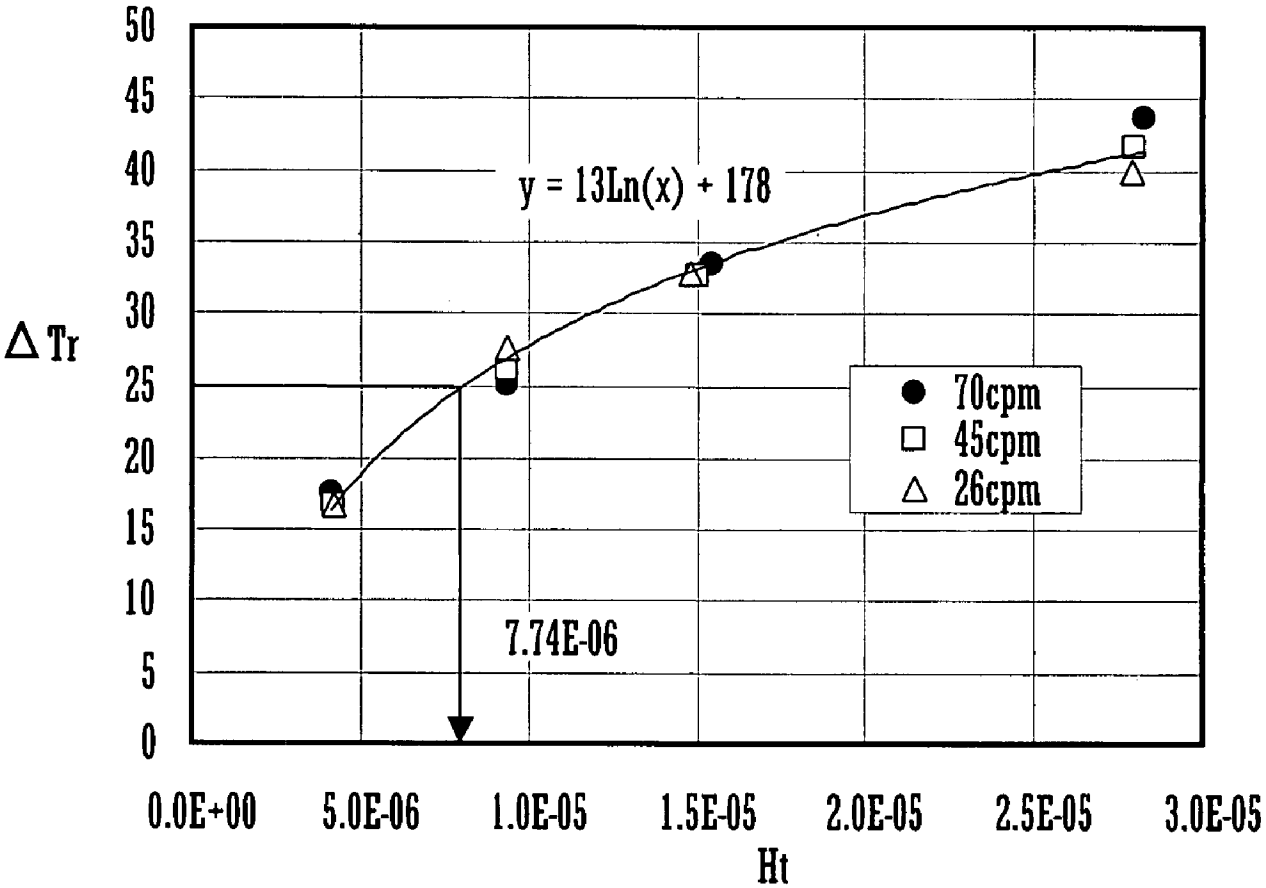
FIG. 15 is a chart showing the relationship between index Ht of temperature variation along the axis of the fixing roller in the heater lamp of the conventional high-speed multifunctional machine and temperature variation ΔTr along the axis of the fixing roller.

FIG. 15 is a sectional view showing the construction of the post-processing device 14. The post-processing device 14 is spaced a predetermined distance apart from the image forming apparatus body 20 (see FIG. 1). The post-processing device 14 and the image forming apparatus body 20 are interconnected via the external transport section 19. Thus, a recording material bearing an image printed thereon by the image forming apparatus body 20 is transported to the post-processing device 14 via the external transport section 19. The external transport section 19 has one end connected to an external delivery section 40 (see FIG. 2) of the image recording device 12 and the other end connected to a recording material receiving section 41 of the post-processing device 14.

The post-processing device 14 has a-sort delivery section 44 capable of delivering recording materials transported thereto to delivery trays 14*a* and 14*b* selectively. The sort delivery section 44 comprises plural rollers 45 and guides 46, and a transport direction switching guide 47 which can be controlled to switch one delivery destination to the other. It is possible for the user to choose one of the delivery trays 14*a* and 14*b* as the recording material delivery destination. Thus, recording materials printed with respective images can be delivered in a sorted fashion.

Examples of possible post-processing include, besides the above-described sorting, stapling of a predetermined number of recording materials, folding of printing sheets of A4 or B4 size or other size, and perforating of recording materials for filing. The post-processing device 14 is provided on the underside thereof with wheels 48 and 49 so as to be easily movable.

It is possible that the post-processing device 14 is provided with the external transport section 19 which is attachable to or detachable from the image recording device 12. Alternatively, the external transport section 19 may be attachable to and detachable from both of the post-processing device 14 and the image forming apparatus body 20.

Figure 6:
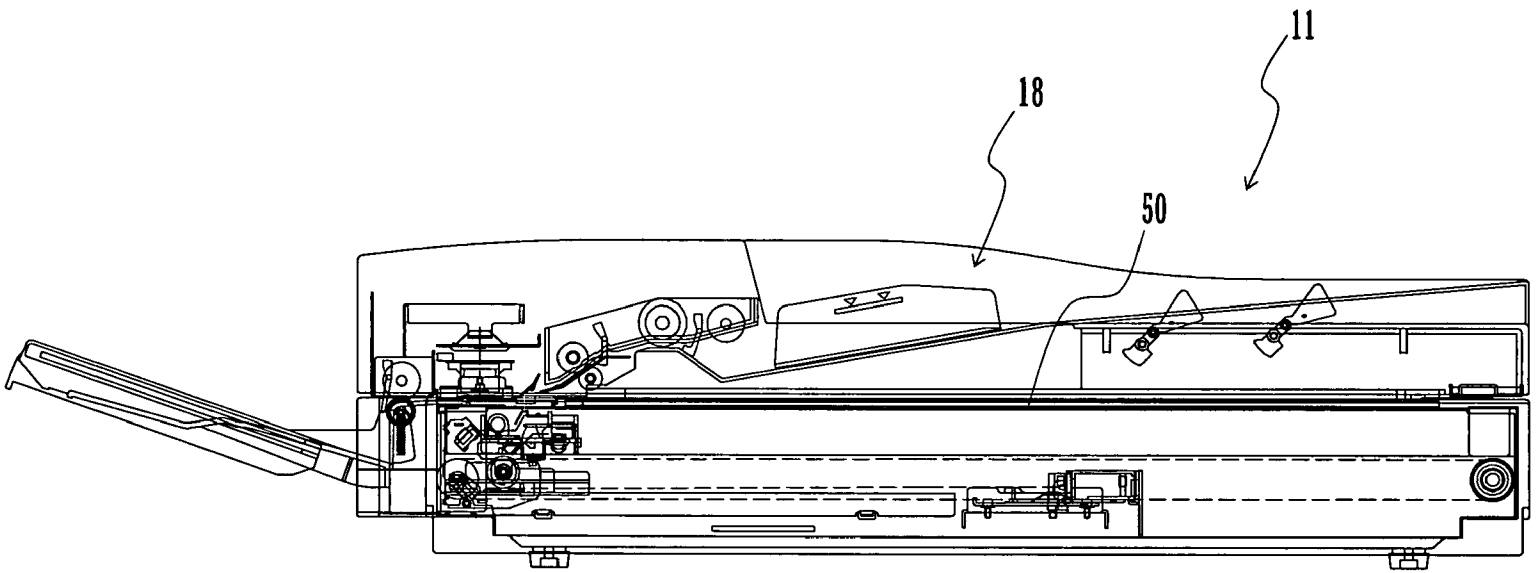
FIG. 6 is an explanatory view showing the construction of an image reader for development.

FIG. 6 is a sectional view showing the construction of the document image reader 11. The document image reader 11 is operable in an automatic reading mode for reading sheet-shaped documents automatically fed from an automatic document feeder (ADF) by exposure-scanning the document sheets one by one and in a manual reading mode for reading a book-shaped document or a sheet-shaped document which the ADF cannot feed automatically by setting such a document manually. The image of a document automatically or manually set on a transparent platen 50 serving as a reading section is scanned by exposure to light, focused on a photoelectric converter and then converted to electric signals, to give image data. The image data thus obtained is outputted via a connector section connected to the image recording device 12.

In reading the both sides of a document, it is possible to read images from the both sides of the document at the same time by scanning the both sides of the document during passage of the document along the document feed path. For reading the lower side of a document a movable exposure-scanning optical system configured to scan the underside of the platen is positioned stationarily at a predetermined position in the document feed path to guide a light image to a CCD thereby reading the document image.

A contact image sensor (CIS) is disposed above the document feed path to read the upper side of the document. The contact image sensor has an integral configuration comprising a light source for exposing a document to light, an optical lens for guiding a light image to the photoelectric converter, and the photoelectric converter for converting the light image to image data. When the double-side document reading mode is selected, documents set on the document feeding section are sequentially fed and images on the both sides of each document under feeding are read substantially simultaneously.

The document image reader 11 is provided with document tray 18. The document tray 18 is used in feeding documents to be read or in receiving documents finished with reading. In feeding documents, when documents to be read are placed on the document tray 18, a pickup section of the ADF picks up each document and feeds it to the platen 50. The document finished with reading is delivered to the outside of the reader by the document delivery section. In receiving documents, when documents are placed in the document feeding section 111, the pickup section of the ADF picks up each document and feeds it to the platen 50. The document finished with reading is delivered to the document tray 18 by the document delivery section.

Figure 5:
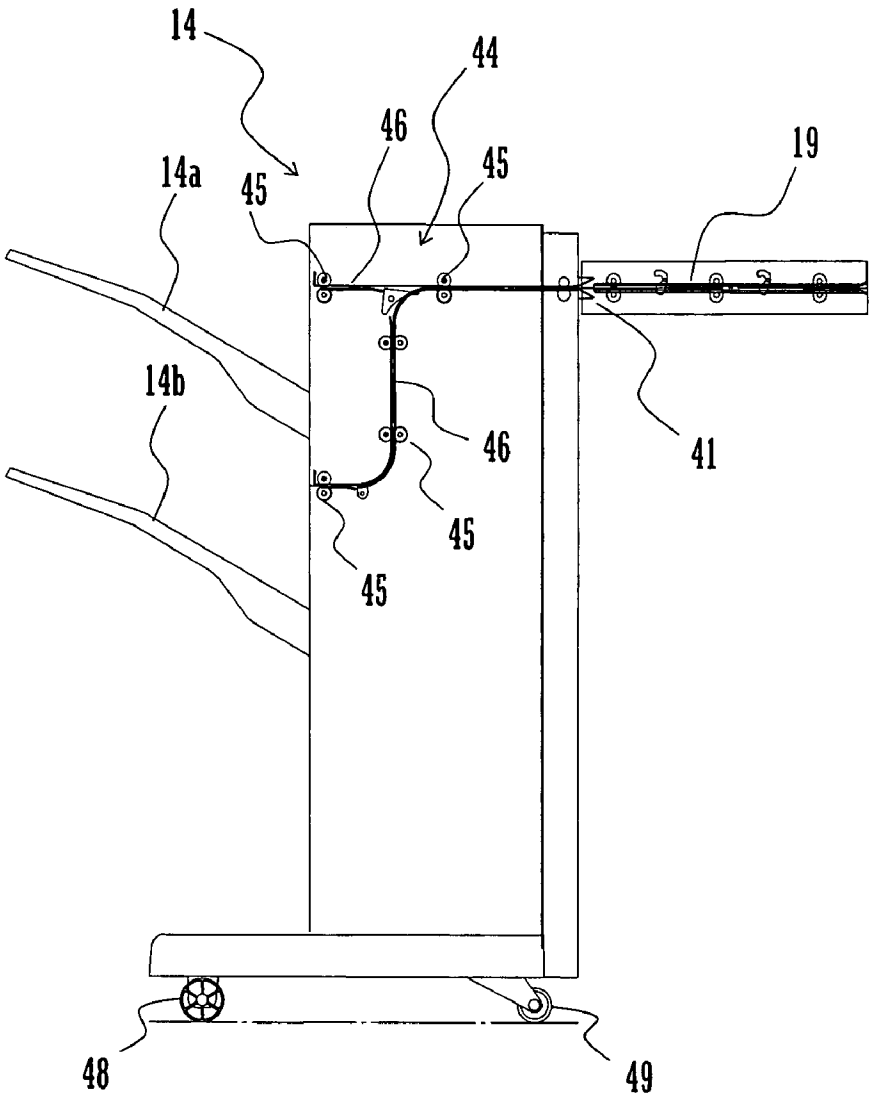
FIG. 5 is an explanatory view showing the construction of a post-processing device.
Figure 7:
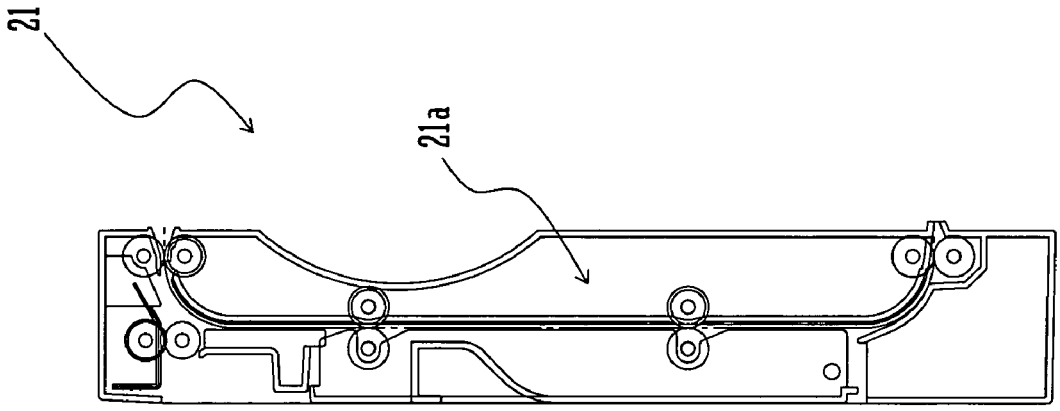
FIG. 7 is an explanatory view showing the construction of a transport device for double-side printing.

FIG. 7 is a sectional view showing the construction of a transport device 21 for double-side printing. The transport device 21 has a vertically oriented transport section 21*a* for double-side printing and is fitted on the left-hand lateral side of the image recording device 12 shown in FIG. 2. The transport section 21*a* switches back and transports a recording material delivered from the fixing unit 23 (see FIG. 2) by utilizing the delivery section 16 located in an upper portion of the image recording device. The transport section 12*a* for double-side printing is capable of turning each recording material upside down and feeding the recording material to between the photosensitive drum 22 and the transfer device 26 in the electrophotographic processing section of the image recording device 12 again. In the image recording device 12, the transport path for delivering each recording material toward the delivery section 16 in the upper portion of the device is capable of guiding a printed recording material to the post-processing device 14 shown in FIG. 5 or to the transport device 21 for double-side printing by switching the recording material back.

Figure 8:
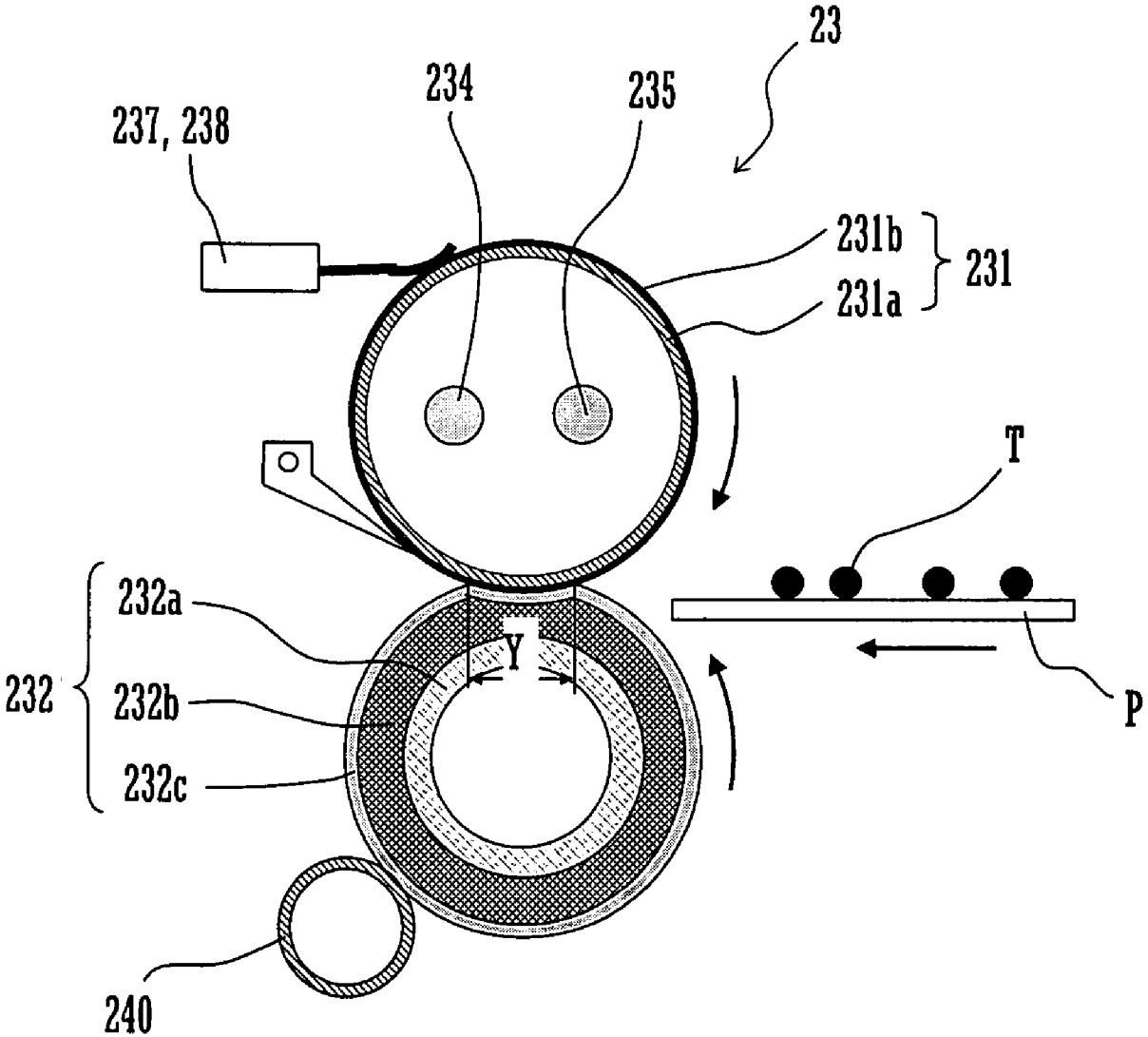
FIG. 8 is an explanatory view showing the construction of a fixing device.

Next, the fixing device 23 will be described in detail with reference to FIG. 8. The fixing device 23 includes a fixing roller 231 (corresponding to the heating member defined by the present invention) as an upper heating member, a pressurizing roller 232 as a lower heating member, heater lamps 234 and 235 as heat sources for the fixing roller, temperature sensors 237 and 238 forming temperature detection means for detecting the temperature of the fixing roller 231, a cleaning roller 240 in sliding contact with the pressurizing roller 232, and a control circuit (not shown) as temperature control means. The heater lamps 234 and 235 correspond to the heating units defined by the present invention and comprise main heater lamps 234*a* and 234*b* and sub-heater lamps 235*a* and 235*b*, respectively.

The heater lamps 234 and 235, each of which comprises a halogen heater, are disposed within the fixing roller 231. When energized by the control circuit, the heater lamps 234 and 235 generate heat to provide predetermined heat distributions, so that the inner peripheral surface of the fixing roller 231 is heated by irradiation with infrared rays.

The fixing roller 231, heated to a predetermined temperature (210° C. in this embodiment) by the heater lamps 234 and 235, serves to heat recording sheet P formed with an unfixed toner image T passing through a fixing nip zone of the fixing device. The fixing roller 231 comprises a core 231*a* as a main body, and a release layer 231*b* formed over the outer peripheral surface of the core 231*a* for preventing toner T on the recording sheet P from offsetting.

The core 231*a* comprises, for example, a metal such as iron, stainless steel, aluminum or copper, or an alloy thereof. In the present embodiment, a core of iron (STKM) having a diameter of 40 mm and a wall thickness of 1.3 mm is used as the core 231*a* in order to lower the heat capacity of the core 231*a*.

Fluroresins such as PFA (tetrafluoroethylene-perfluoroalkylvinyl ether copolymer) and PTFE (polytetrafluoroethylene), silicone rubber, fluororubber, and the like are suitable for the release layer 231*b*. The release layer 231*b* is formed by coating the core 231*a* with a blend of PFA and PTFE to a thickness of 25 μm and then baking the coat. In the present embodiment, the rated output of the heater lamp 234 is 650 W and that of the heater lamp 235 is 250 W.

The pressurizing roller 232 comprises a core 232*a* of steel, stainless steel, aluminum or the like, and a heat-resistant resilient layer 232*b* of silicone rubber or the like covering the outer peripheral surface of the core 232*a*. A release layer 232*c* comprising the same fluororesin as in the fixing roller may be formed over the surface of the heat-resistant resilient layer of the pressurizing roller 232. In the present embodiment, the pressurizing roller 232 comprises the core 232*a* of stainless steel having a diameter of 40 mm, the heat-resistant resilient layer 232*b* of silicone rubber having a thickness of 5 mm, and the release layer 232*c* covering the surface of the heat-resistant resilient layer 232*b*, the release layer 232*c* comprising a PFA tube having a thickness of 50 μm. The pressurizing roller 232 is pressed against the fixing roller 231 with a force of 745 N by means of a non-illustrated pressurizing member such as a spring thereby defining the fixing nip zone Y having a width of about 6 mm between the fixing roller and the pressurizing roller 232.

The cleaning roller 240 serves to prevent the pressurizing roller 232 from being stained with toner and paper particles by eliminating such toner, paper particles and the like adhering to the pressurizing roller 232. Specifically, the cleaning roller 240 is pressed against the pressurizing roller 232 with a predetermined force and driven to rotate with rotation of the pressurizing roller 232. The cleaning roller 240 comprises a cylindrical metal core made of aluminum, an iron material or the like. The present embodiment uses a stainless steel material for the cleaning roller 240.

The fixing roller 231 is provided on its peripheral surface with thermistors 237 and 238 as the temperature detection means for detecting the surface temperature of the fixing roller. The control circuit (not shown) controls the passage of current through the heater lamps 234 and 235 based on temperature data detected by each thermistor so that the temperature of the fixing roller is held at a predetermined temperature.

Next, detailed description will be made of embodiments of heater lamps 234 and 235 as the heating means.

Figure 20:
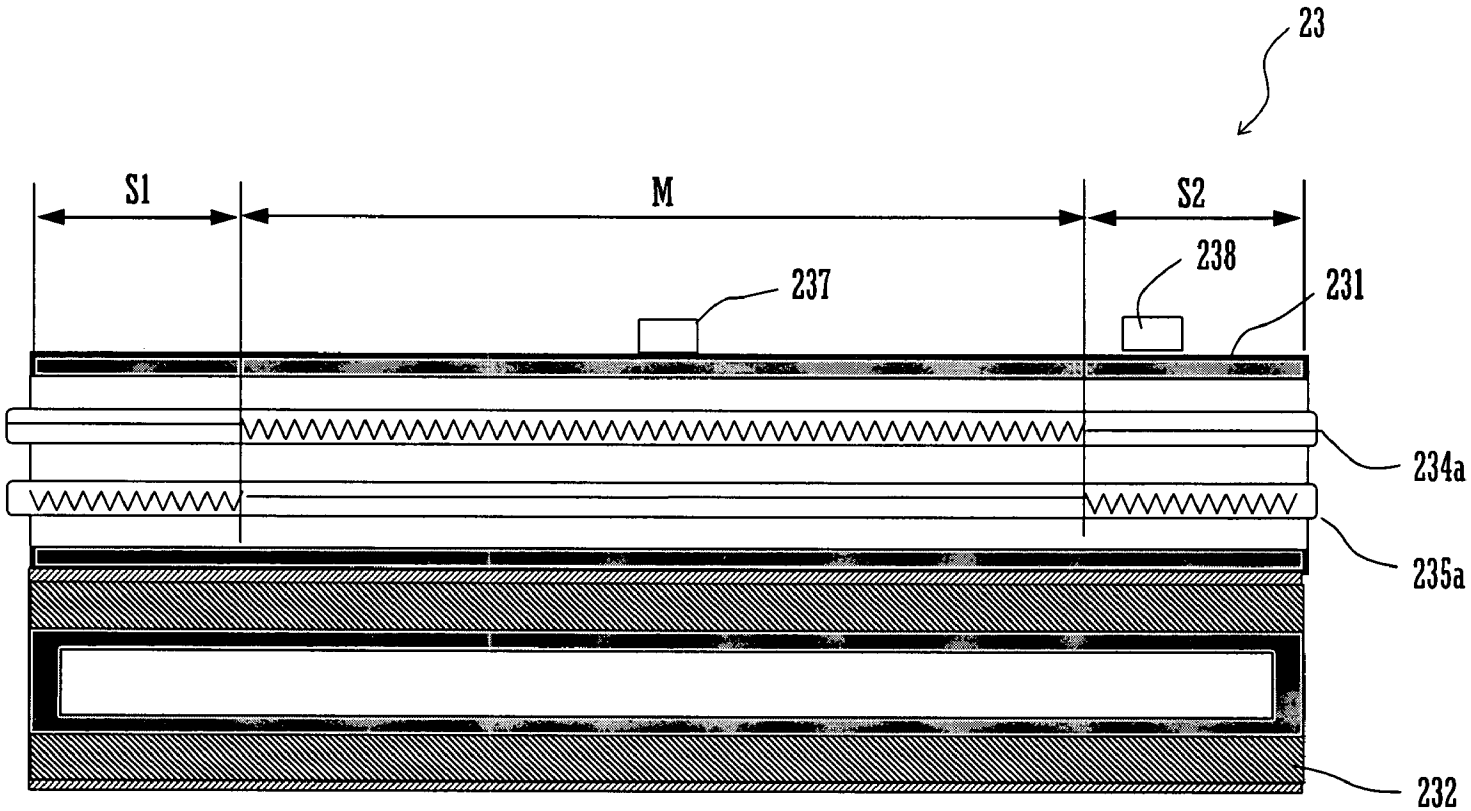
FIG. 20 is a view showing heat generating section and no-heat generating section of each heater lamp according to embodiment 1.

FIG. 20 schematically illustrates the construction of the so-called center registration type fixing device through which recording sheets are to be passed with the center position of the fixing roller 231 used as a reference wherein the heating device of the present invention is used. The heater lamps as the heating units of the fixing device include two heater lamps 234*a* and 235*a*, the heater lamp 234*a* being a main heater lamp for heating a central portion of the fixing roller, the heater lamp 235*a* being a sub-heater lamp for heating the opposite end portions of the fixing roller.

The heater lamps each comprise a hollow glass tube (bulb) in which filament of tungsten and halogen-type inert gas are encapsulated and are each configured to cause the filament to generate Joule heat to an elevated temperature by passing current through the filament thereby radiating infrared rays.

The heat generating section (light emitting section) of the main heater lamp 234*a* is positioned to face a central portion of each recording sheet and extends in a region (M) which substantially coincides with a sheet passage region corresponding to a B5R-size sheet which is used particularly-frequently among small-sized sheets and the temperature rise at the sheet non-passage portion is most conspicuous. The heat generating section of the sub-heater lamp 235*a* extends in regions (S1 and S2) covering the no-heat generating sections (no-light emitting sections) of the main heater lamp. Thus, the region (M) extending in the central portion of the fixing roller is supplied with heat mainly by the main heater lamp 234*a*, while the regions S1 and S2 extending in respective of opposite end portions of the fixing roller supplied with heat by the sub-heater lamp 235*a*. The no-heat generating sections are formed to be continuous with the heat generating section in the main heater lamp 234*a*, while the no-heat generating section formed to be continuous with the heat generating sections in the sub-heater lamp 235*a*. The heat generating sections of the sub-heater lamp 235*a* are opposed to the no-heat generating sections of the main heater lamp 234*a*, while the no-heat generating section of the sub-heater lamp 235*a* opposed to the heat generating section of the main heater lamp 234*a*.

A total of two thermistors are provided as the temperature sensors; one thermistor 237 is disposed in the heat generating section M of the main heater 234*a* and the other thermistor 238 disposed in the heat generating section S2 of the sub-heater lamp 235*a*. A signal detected by each thermistor is inputted to a non-illustrated control section comprising a CPU. The control section is configured to control current passing through each heater by means of a non-illustrated driver based on the surface temperature detected. That is, the control section controls the main heater lamp 234*a* based on the output of detection by the thermistor 237 and the sub-heater lamp 235*a* based on the output of detection by the thermistor 238 individually and independently.

Figure 9:
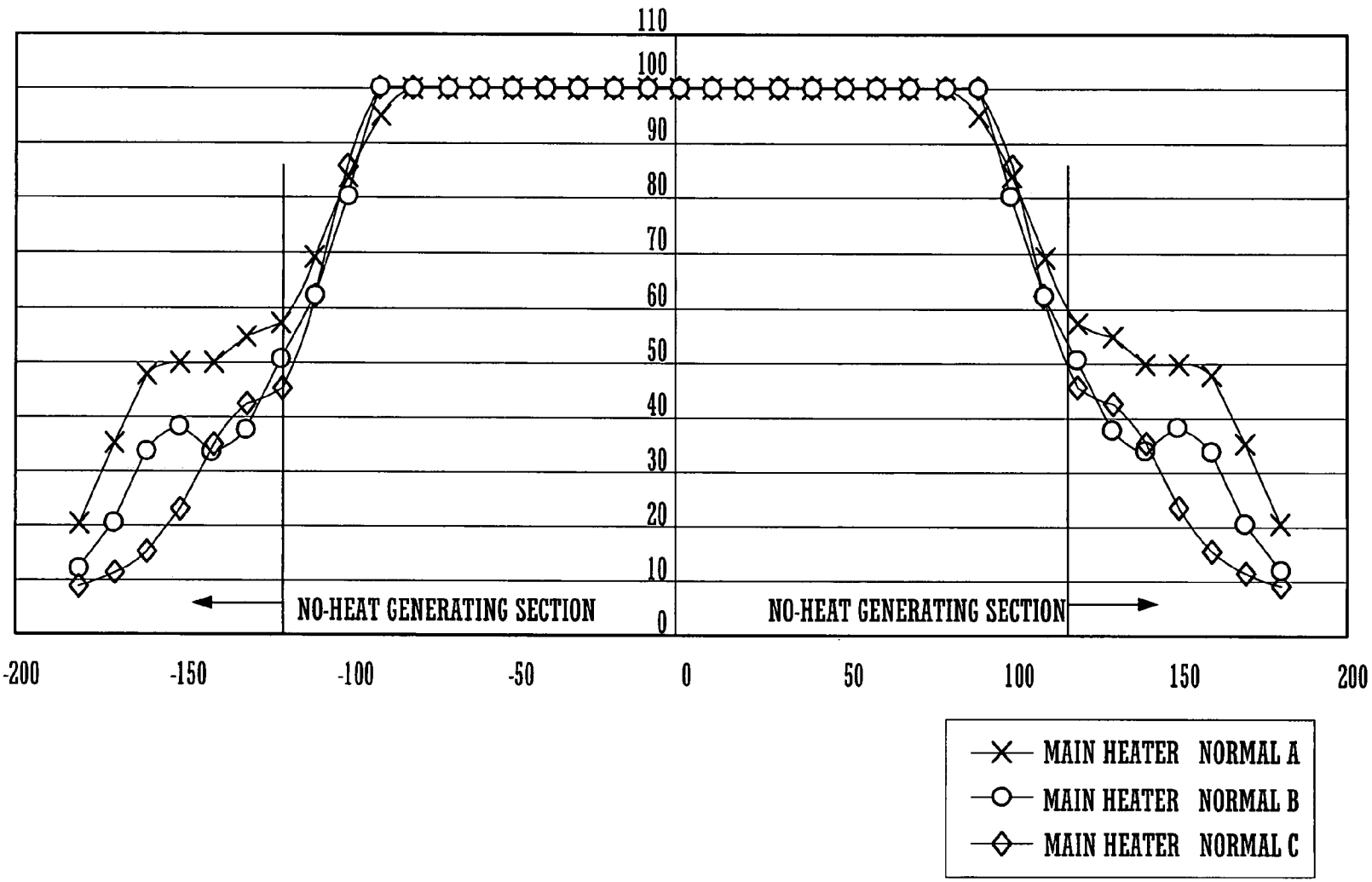
FIG. 9 is a chart showing heat distributions (relative values) of heater lamps.
Figure 10:
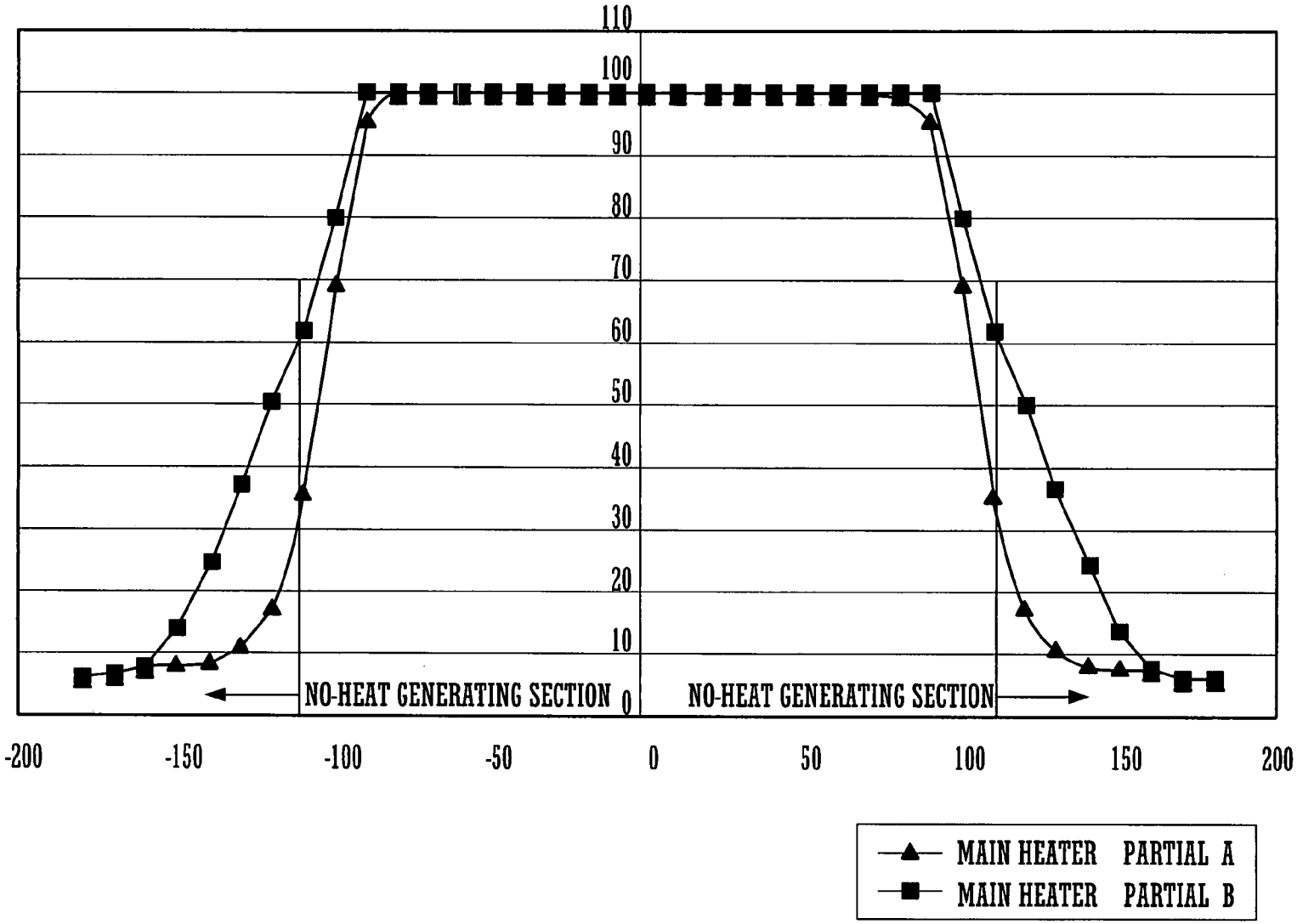
FIG. 10 is a chart showing heat distributions (relative values) of heater lamps in another case.
Figure 11:
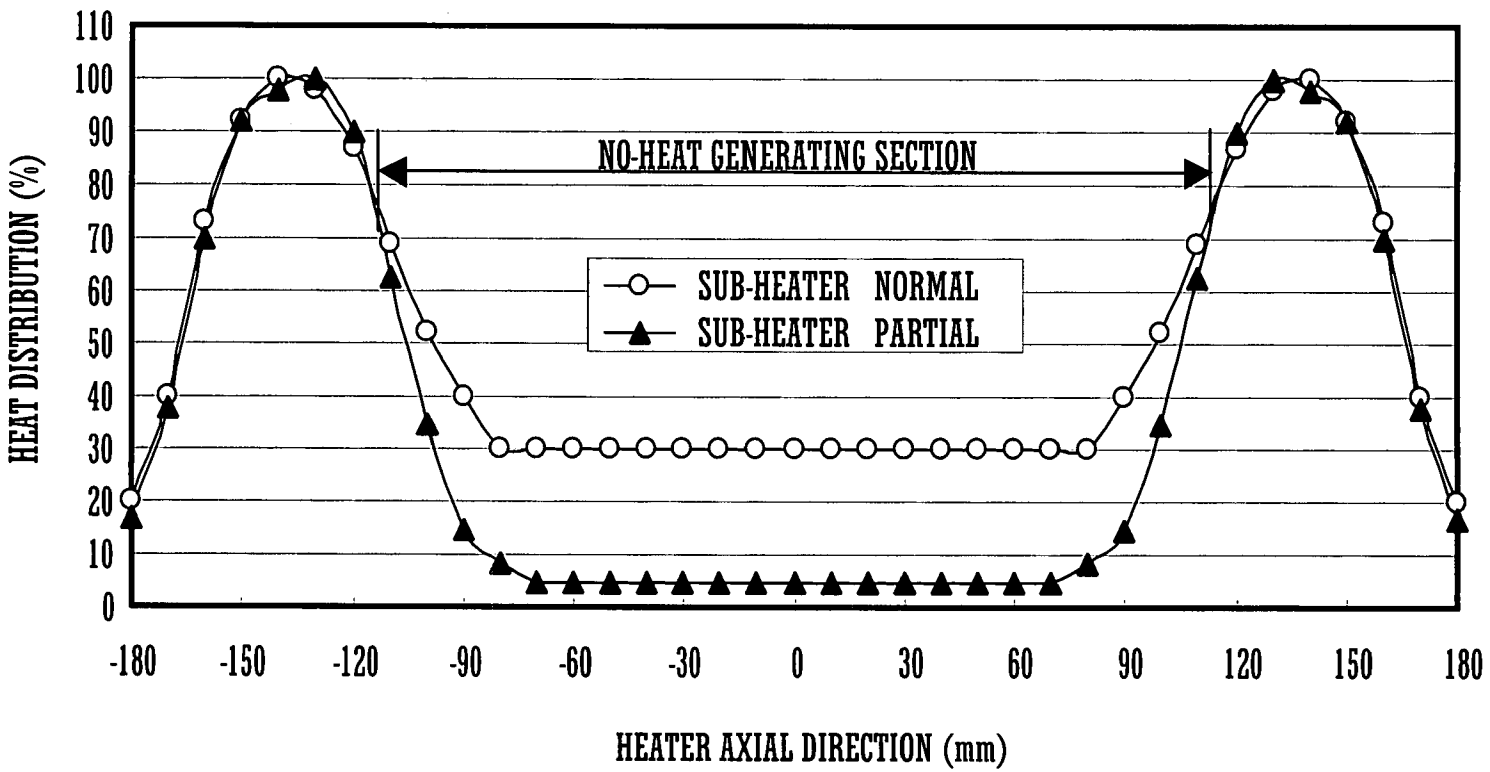
FIG. 11 is a chart showing heat distributions (relative values) of heater lamps in yet another case.
Figure 12:
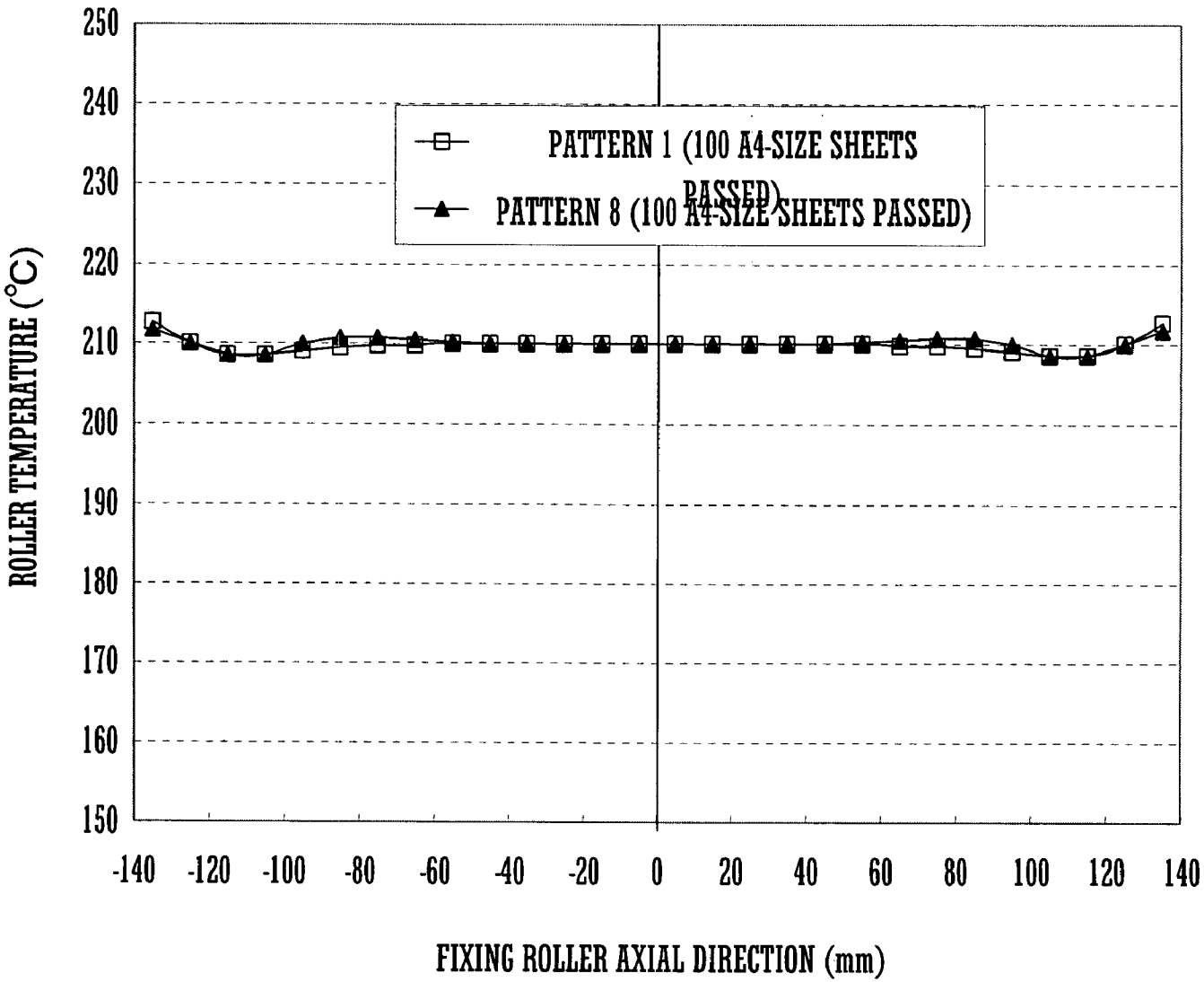
FIG. 12 is a chart showing an example of temperature distribution along the axis of a fixing roller in a heater lamp of a conventional high-speed multifunctional machine.
Figure 13:
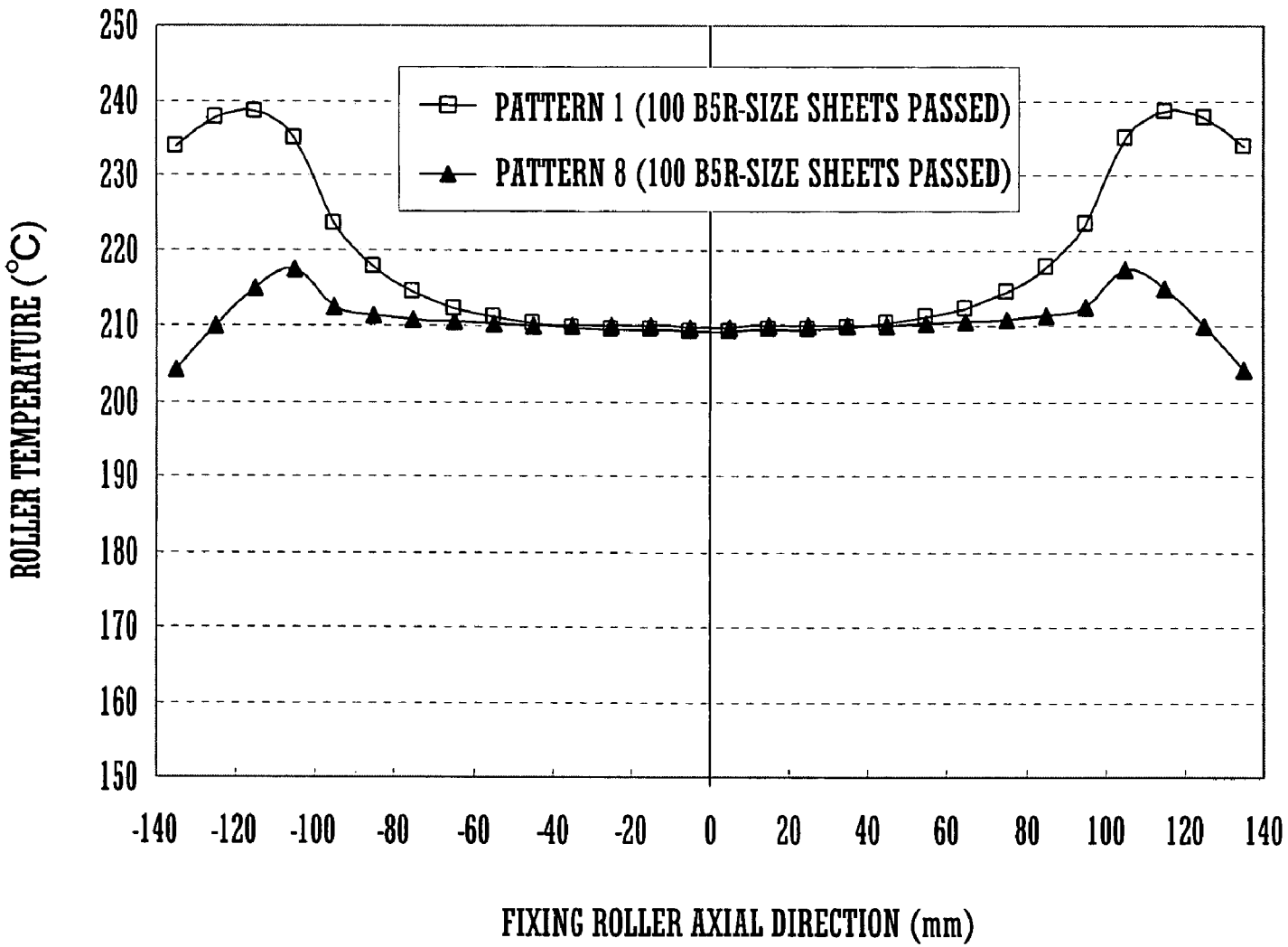
FIG. 13 is a chart showing another example of temperature distribution along the axis of the fixing roller in the heater lamp of the conventional high-speed multifunctional machine.
Figure 14:
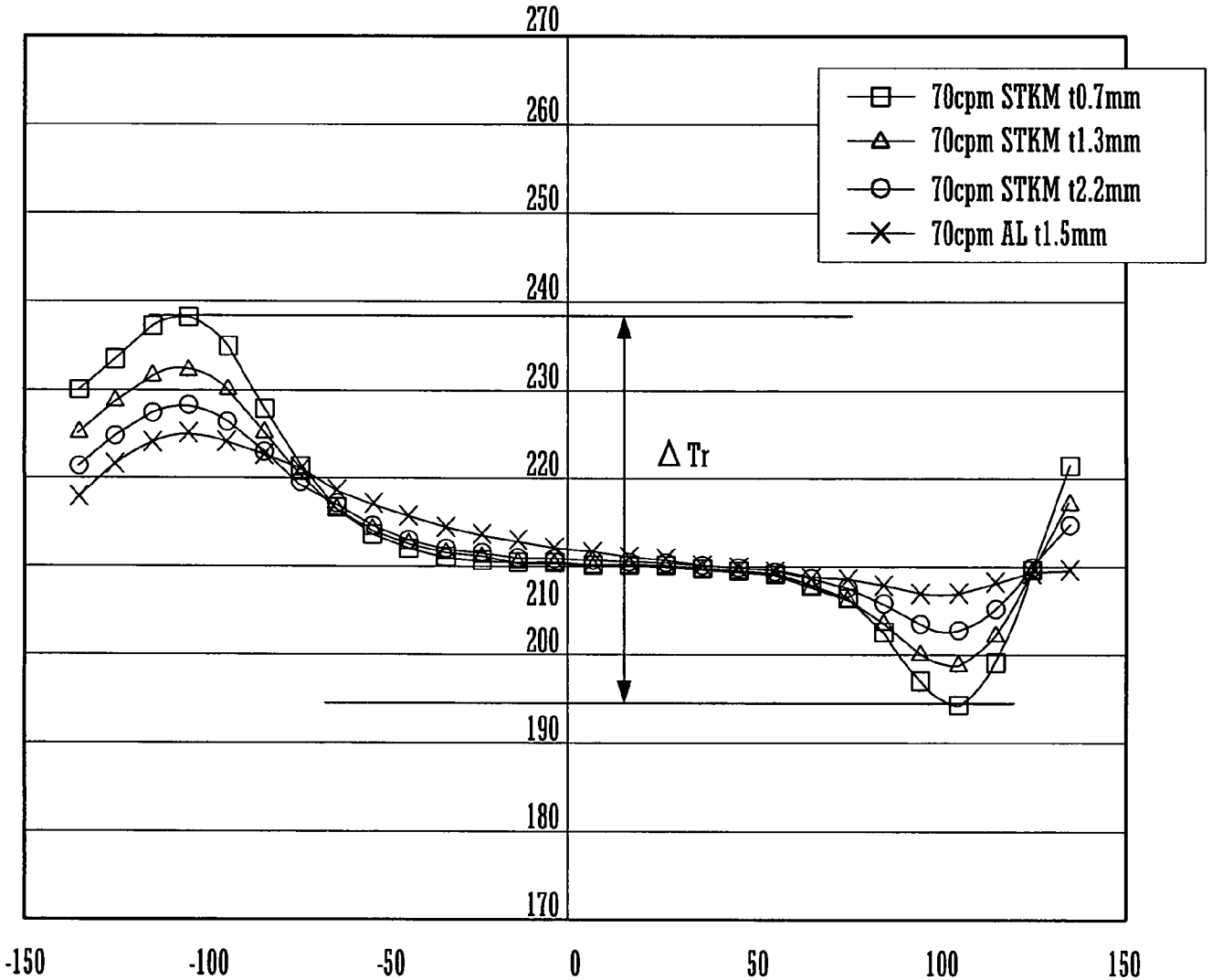
FIG. 14 is a chart showing temperature variation along the axis of the fixing roller caused by positional deviation of heat distribution of the heater lamp of the conventional high-speed multifunctional machine.

With reference to Table 1 and FIGS. 9 to 11, description will be made of the results of examination of heat distributions of respective of the main heater lamp 234*a* and the sub-heater lamp 235*a*.

The heat distributions of the main heater lamp 234*a* and sub-heater lamp 235*a* shown in the table and figures were determined in the following manner. A calorimeter was placed at a location spaced apart from the center of each heater lamp by a distance equal to the radius of the fixing roller (20 mm in this embodiment) and caused to scan axially of each of the heater lamps 234*a* and 235*a* generating heat at their respective rated powers to determine a calorific value distribution along the axis of the tube of each heater lamp. Calorific values of different portions along the axis of the tube of each heater lamp are shown as relative values (%) to the maximum calorific value, which is assumed 100%.

Here, the extent along the axis of the tube of each heater lamp which was subjected to measurement was the extent in which the tungsten filament was present. In this examination, eight patterns of combination of main heater lamp and sub-heater lamp were used to provide eight different combinations of heat distributions as can be seen from FIGS. 9 to 11 and Table 1.

TABLE 1

| | | Pattern 1 | Pattern 2 | Pattern 3 | Pattern 4 | Pattern 5 | Pattern 6 | Pattern 7 | Pattern 8 |
|---|---|---|---|---|---|---|---|---|---|
| Main Heater | Type | Normal A | Normal B | Normal C | Normal B | Partial A | Normal C | Partial B | Partial A |
| | MRnh (%) | 48.0 | 35.9 | 30.5 | 35.9 | 13.1 | 30.5 | 26.3 | 13.1 |
| Sub Heater | Type | Normal | Normal | Normal | Partial | Normal | Partial | Partial | Partial |
| | SRnh (%) | 36.5 | 36.5 | 36.5 | 14.2 | 36.5 | 14.2 | 14.2 | 14.2 |
| Σ Rnh (%) | | 84.5 | 72.3 | 67.0 | 50.1 | 49.5 | 44.7 | 40.5 | 27.2 |

In Table 1, MRnh represents a mean value of heat distribution (relative value) in the no-heat generating section of the main heater lamp 234*a*. Specifically, a region in which the heat distribution (relative value) is less than 70% is defined as a no-heat generating section and MRnh is an index indicative of a mean value of heat distribution (relative value) in the no-heat generating section.

Similarly, SRnh represents a mean value of heat distribution (relative value) in the no-heat generating section of the sub-heater lamp 235*a*. A region in which the heat distribution (relative value) is less than 70% is defined as a no-heating generating portion and SRnh is an index indicative of a mean value of heat distribution (relative value) in the no-heat generating section. It should noted that, though the central portion and opposite end portions of the sub-heater lamp each has a region in which the heat distribution is less than 70%, only the region of the central portion in which the heat distribution is less than 70% is herein defined as the no-heat generating section while the regions of the opposite end portions in which the heat distribution is less than 70% are defined as heat generating sections as shown in FIG. 11.

Further, ΣRnh is the sum total of the mean values of the heat distributions (relative values) in respective of the no-heat generating sections of all the heating means. Here, ΣRnh is represented by the formula (5):

$$\Sigma Rnh = MRnh + SRnh \qquad \text{formula (5).}$$

fixing roller axis obtained after the passage of the 100 recording sheets was determined using a two-dimensional radiation thermometer to find ΔTr. The results of the experiment were as shown in Table 4 and FIG. 16.

TABLE 3

| | | | |
|---|---|---|---|
| Print Speed (cpm) | | 70 | |
| Fixing Speed vp (mm/s) | | 395 | |
| Roller Specifications | Roller 1 | Roller 2 | Roller 3 |
| Material | Iron | Iron | Iron |
| Heat Conductivity λ (W/m ° C.) | 45 | 45 | 45 |
| Wall Thickness t (mm) | 0.70 | 1.30 | 2.20 |
| Outer Diameter D (mm) | 40 | 40 | 40 |
| Length L (mm) | 316 | 316 | 316 |
| Heat Capacity per Unit Length Mh (J/° C. · m) | 310 | 567 | 937 |
| Temperature Variation Index Ht ($m^3/J^2$) | 2.8E-05 | 1.5E-05 | 9.4E-06 |

TABLE 4

| Heater Lump Heat Distribution Pattern | | Temperature Variation ΔTr (deg) | | | ΔTr = A · Ln (Ht) + B | | |
|---|---|---|---|---|---|---|---|
| Pattern | Σ Rnh (%) | Roller 1 | Roller 2 | Roller 3 | A | B | Ht (ΔTr = 25) |
| Pattern 1 | 84.45 | 19.0 | 14.5 | 11.0 | 7.2 | 94.2 | 6.58E-05 |
| Pattern 2 | 72.33 | 23.3 | 17.9 | 13.3 | 9.0 | 117.9 | 3.41E-05 |
| Pattern 3 | 66.95 | 24.0 | 18.6 | 14.0 | 9.0 | 118.7 | 3.16E-05 |
| Pattern 4 | 50.06 | 30.0 | 23.1 | 17.4 | 11.3 | 148.6 | 1.83E-05 |
| Pattern 5 | 49.52 | 30.9 | 23.6 | 17.5 | 12.1 | 157.7 | 1.74E-05 |
| Pattern 6 | 44.68 | 31.2 | 24.3 | 18.4 | 11.5 | 152.1 | 1.65E-05 |
| Pattern 7 | 40.5 | 32.8 | 25.7 | 19.5 | 12.1 | 159.5 | 1.48E-05 |
| Pattern 8 | 27.2 | 43.7 | 33.4 | 25.0 | 16.9 | 220.5 | 9.38E-06 |

Experiment 1

Firstly, an experiment was conducted to examine temperature variation along the fixing roller axis in each of the combinations of heater lamps (patterns 1 to 8) due to positional deviations of respective heat distributions of the heater lamps.

As described in the heading "PROBLEMS TO BE SOLVED BY THE INVENTION", temperature variation ΔTr along the fixing roller axis occurs if the heat distributions of respective of the main heater lamp 234*a* and the sub-heater lamp 235*a* deviate from their respective established values. Patterns 1 to 8 of heater lamps were compared with each other as to temperature variation ΔTr along the fixing roller axis in the case where the heat distribution deviated to the maximum of 10 mm (specifically, the heat distribution of the main lamp was established to deviate 5 mm toward the minus side (left-hand side) from the sheet passage reference position and the heat distribution of the sub-lamp established to deviate 5 mm toward the plus side (right-hand side) from the sheet passage reference position.)

Figure 16:
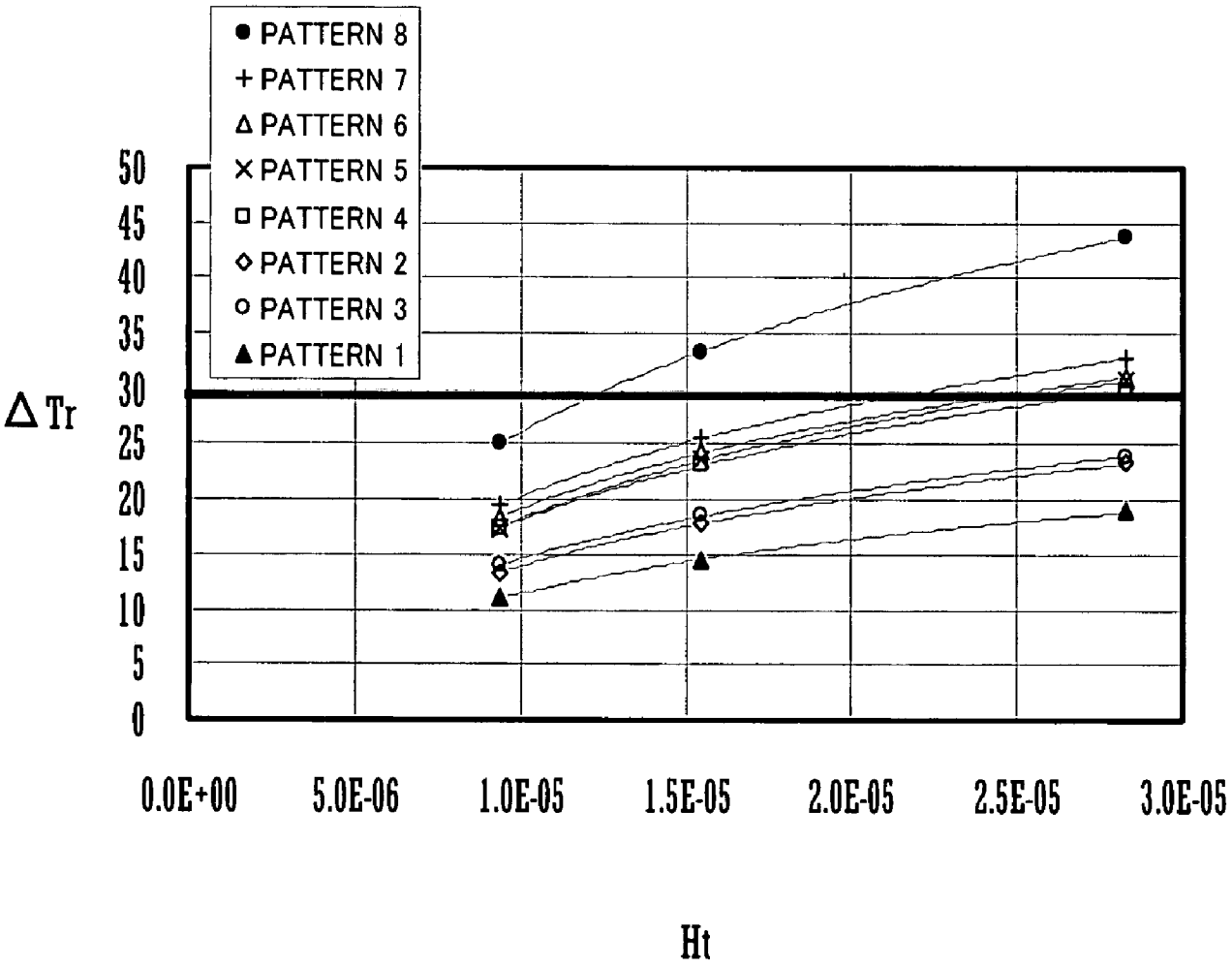
FIG. 16 is a chart showing the relationship between Ht and ΔTr varying with positional deviation of heat distribution of heater lamps in each of plural heat distribution patterns according to an embodiment of the present invention.

The experiment was conducted according to a method wherein: using three types of fixing rollers (any one of which was made of iron) of the shapes, characteristics and operating conditions shown in Table 3, 100 A4-size recording sheets were successively passed as aligned with the sheet passage reference position determined on the center registration basis with each fixing roller under temperature control at 210° C.; and the temperature distribution along the Table 4 and FIG. 16 show the relationship between temperature variation ΔTr along the fixing roller axis and the sum total ΣRnh of mean values of heat distributions (relative values) in respective of the no-heat generating sections of all the heater lamps and the relationship between temperature variation ΔTr along the fixing roller axis and index Ht of temperature variation along the fixing roller axis.

As described in the heading "PROBLEMS TO BE SOLVED BY THE INVENTION", Ht, as used herein, is an index defined by the formula (6):

$$Ht = vp/(Mh \cdot \lambda) \qquad \text{formula (6)}$$

where Mh(J/(° C.·m)) is the heat capacity of the fixing roller, λ(W/(m·° C.)) is the heat conductivity of the fixing roller, and Vp(m/s) is the fixing speed.

As can be understood from the formula (6), the index Ht of temperature variation along the fixing roller axis and ΔTr can be approximated to each other regardless of the heat distribution pattern by the formula (7):

$$\Delta Tr = A \cdot Ln(Ht) + B \qquad \text{formula (7),}$$

and ΔTr increases with decreasing ΣRnh. With the tolerance of ΔTr established to be 25 deg or less, determination was conducted in each of the heat distribution patterns to find conditions in each of which Ht satisfied ΔTr=25 (hereinafter will be referred to as Ht(ΔTr=25)). The results obtained were as shown in the rightmost column of Table 4.

Figure 18:
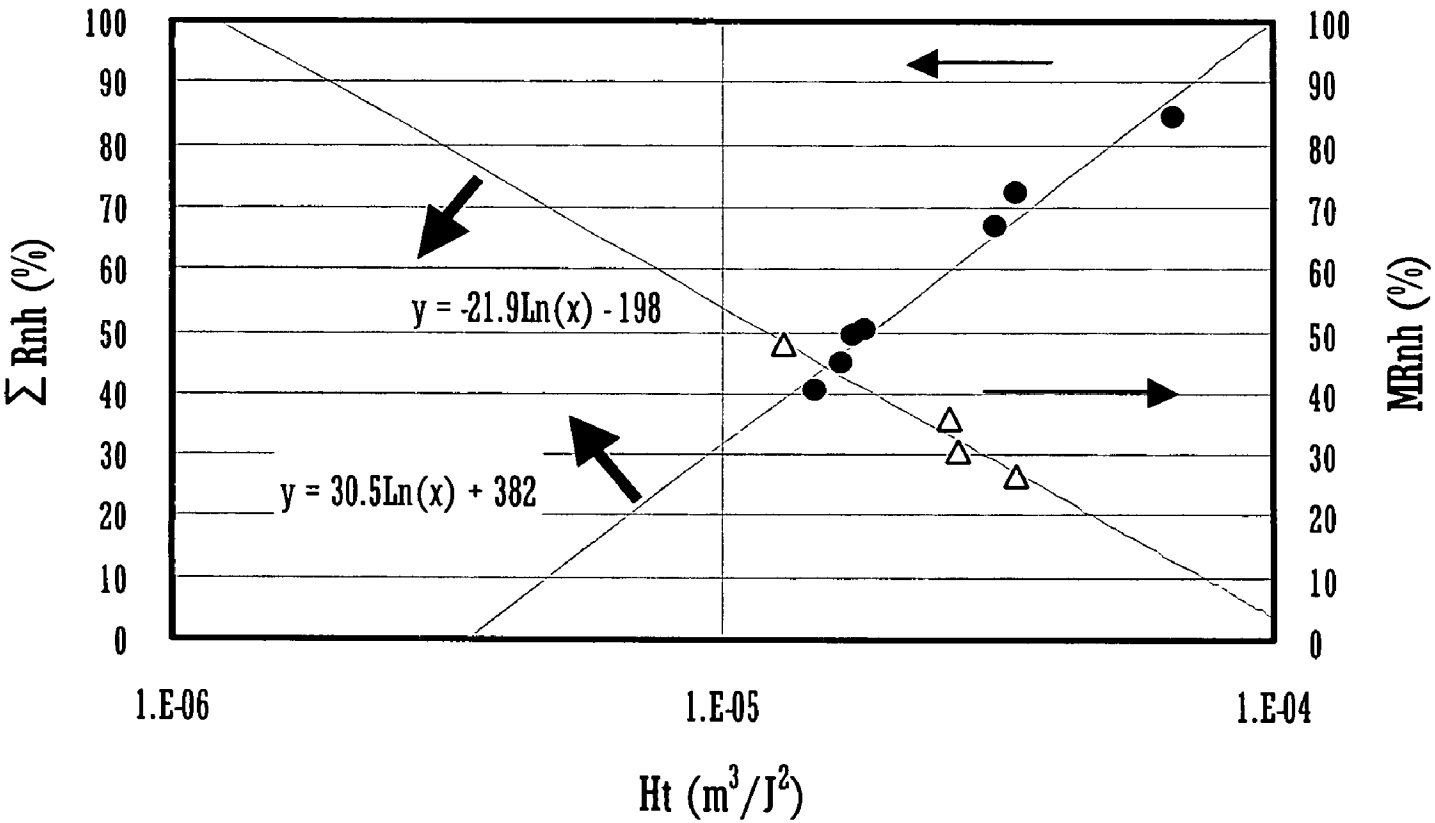
FIG. 18 is a chart showing the relationship between Ht and ΣRnh varying with positional deviation of heat distribution and the relationship between Ht and MRnh during passage of small-sized recording sheets.

FIG. 18 shows the relationship between Ht(ΔTr=25) and ΣRnh. From FIG. 18, the following formula (8) holds between Ht(ΔTr=25) and ΣRnh.

$$\Sigma Rnh=30.5\cdot Ln(Ht)+382 \quad \text{formula (8)}$$

Therefore, the condition satisfying ΔTr≦25 deg is expressed by the formula (1):

$$\Sigma Rnh\geqq 30.5\cdot Ln(Ht)+382 \quad \text{formula (1).}$$

Experiment 2

Next, an experiment was conducted to examine and compare temperature rises at the sheet non-passage portion which occurred during successive passage of small-sized paper sheets.

Specifically, as in experiment 1, experiment 2 was conducted according to a method wherein: using patterns 1 to 8 of heater lamps and three types of fixing rollers (any one of which was made of iron) of the shapes, characteristics and operating conditions shown in Table 3, 100 B5R-size recording sheets were successively passed as aligned with the sheet passage reference position determined on the center registration basis with each fixing roller under temperature control at 210° C.; and the temperature distribution along the fixing roller axis obtained after the passage of the 100 recording sheets was determined using a two-dimensional radiation thermometer. In experiment 2 the position of heat distribution of each heater lamp was a regular position (the center reference position).

Figure 17:
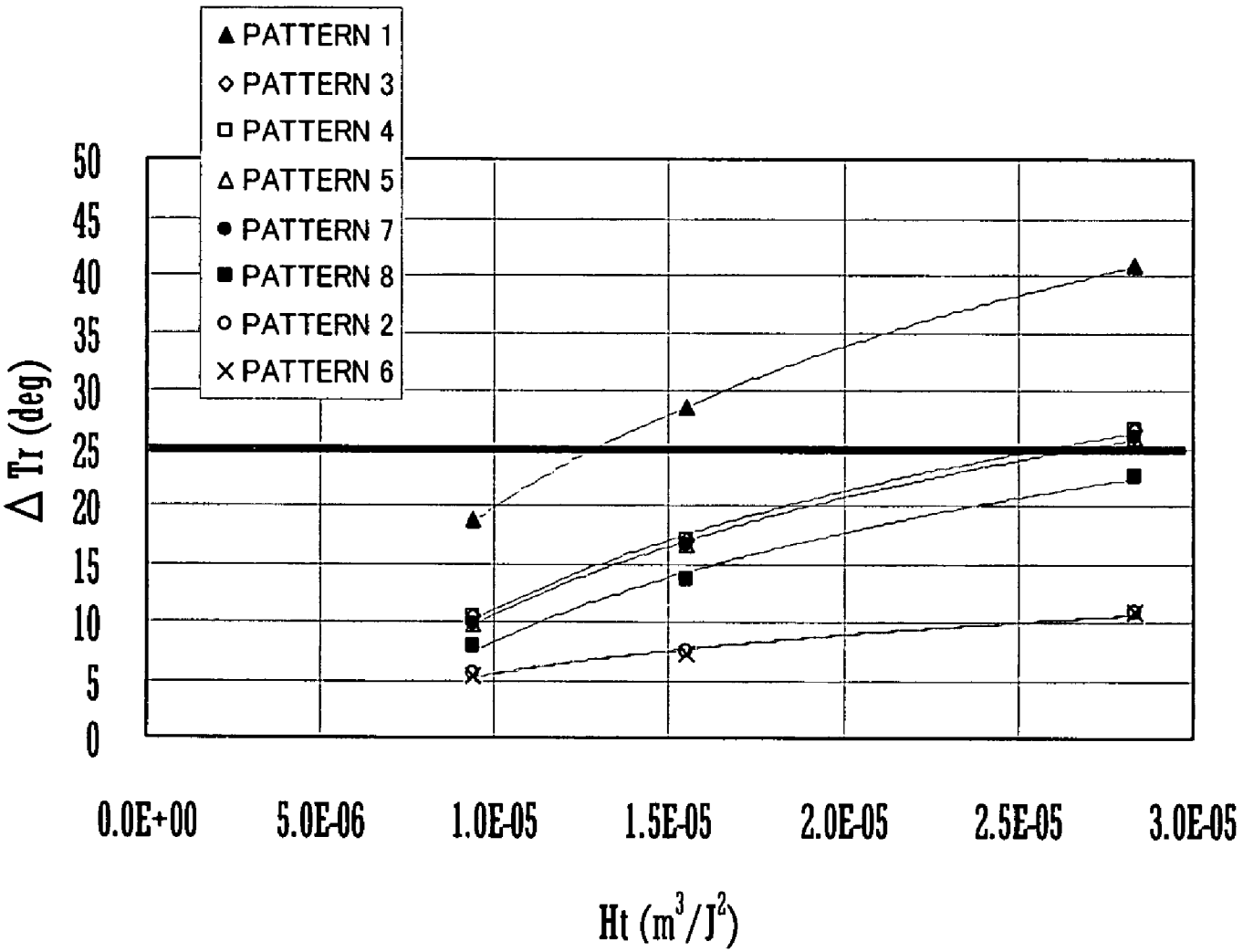
FIG. 17 is a chart showing the relationship between Ht and ΔTr during passage of small-sized recording sheets in each of the plural heat distribution patterns according to the embodiment of the present invention.

Table 5 and FIG. 17 show the relationship between the mean value MRnh of heat distribution (relative values) in the no-heat generating-sections of the main heater lamp 234*a* and the temperature variation ΔTr along the fixing roller axis. The relationship between MRnh and ΔTr was examined here because the main heater lamp 234*a* is considered to be a main factor causing ΔTr to occur since the sub-heater lamp 235*a* is hardly turned on during passage of small-sized sheets.

FIG. 18 shows the relationship between Ht(ΔTr=25) and MRnh. From FIG. 18, the following formula (9) holds between Ht(ΔTr=25) and MRnh.

$$MRnh=-21.9\cdot Ln(Ht)-198 \quad \text{formula (9)}$$

Therefore, the condition satisfying ΔTr≦25 deg is expressed by the formula (2):

$$MRnh\leqq -21.9\cdot Ln(Ht)-198 \quad \text{formula (2).}$$

As can be understood from the results stated above, if the mean value MRnh of heat distribution (relative value) in the no-heat generating sections of the main heater lamp 234*a* is more than −21.9·Ln(Ht)−198, the temperature rise at the sheet non-passage portion becomes too large (more than 25 deg), which causes the occurrence of high-temperature offset, paper wrinkling or the like.

Also, if the sum total ΣRnh of the mean values of the heat distributions (relative values) in respective of the no-heat generating sections of all the heating means is less than 30.5·Ln(Ht)+382, the temperature variation due to variation in the heat distributions along the axes of the main heater lamp 234*a* and sub-heat lamp 235*a* becomes too large (more than 25 deg), which causes the occurrence of high-temperature offset, paper wrinkling or the like.

Therefore, the occurrence of high-temperature offset, paper wrinkling or the like can be prevented even when variation occurs in the heat distributions of respective of the main heater lamp 234*a* and the sub-heater lamp 235*a* if the heat distributions of respective of the main heater lamp 234*a* and the sub-heater lamp 235*a* are established so that both of the formulae (1) and (2) hold.

Specific means which is capable of realizing such heat distributions is an arrangement wherein a heater lamp of the so-called partial type having a shortcircuiting stem inserted into the filament coil in its no-heat generating section is used for only one of the main heater lamp and the sub-heater lamp, as can be seen from Table 1.

TABLE 5

| Heater Lump Heat Distribution Pattern | | Temperature Variation ΔTr (deg) | | | ΔTr = A · Ln (Ht) + B | | |
|---|---|---|---|---|---|---|---|
| Pattern | MRnh (%) | Roller 1 | Roller 2 | Roller 3 | A | B | Ht (ΔTr = 25) |
| Pattern 1 | 48.00 | 40.8 | 28.5 | 18.6 | 20.0 | 250.5 | 1.29E-05 |
| Pattern 3 | 35.88 | 26.6 | 16.9 | 10.4 | 14.7 | 180.0 | 2.58E-05 |
| Pattern 4 | 35.88 | 26.6 | 16.9 | 10.4 | 14.7 | 180.0 | 2.58E-05 |
| Pattern 5 | 30.50 | 26.0 | 16.5 | 9.9 | 14.6 | 178.4 | 2.69E-05 |
| Pattern 7 | 30.50 | 26.0 | 16.5 | 9.9 | 14.6 | 178.4 | 2.69E-05 |
| Pattern 8 | 26.31 | 22.6 | 13.6 | 7.8 | 13.5 | 163.3 | 3.44E-05 |
| Pattern 2 | 13.06 | 10.8 | 7.4 | 5.4 | 4.9 | 61.5 | 5.46E-04 |
| Pattern 6 | 13.06 | 10.8 | 7.3 | 5.4 | 4.9 | 61.7 | 5.43E-04 |

As can be understood from Table 5 and FIG. 17, the relationship between Ht and ΔTr can be approximated to each other regardless of the heat distribution pattern by the above-noted formula (7), and ΔTr increases with increasing MRnh. With the tolerance of ΔTr established to be 25 deg or less, determination was conducted in each of the heat distribution patterns to find conditions in each of which Ht satisfied ΔTr=25 (hereinafter will be referred to as Ht (ΔTr=25)). The results obtained were as shown in the rightmost column of Table 5.

Experiment 3

Next, power consumptions of the heat distribution patterns were examined by comparison.

Specifically, experiment 3 was conducted according to a method wherein: using patterns 1 to 8 of heater lamps and a fixing roller comprising roller 2 (wall thickness: 1.3 mm) shown in Table 3, the power consumption of each heater lamp was measured by a wattmeter with the fixing roller under temperature control at 210° C. as in experiment 1 under each of the three conditions:

(1) 100 A4-size recording sheets were successively passed with the heat distribution in the regular position;

(2) 100 A4-size recording sheets were successively passed with the maximum heat distribution deviation of 10 mm as in experiment 1; and (3) 100 B5R-size recording sheets were successively passed with the heat distribution in the regular position.

Figure 19:
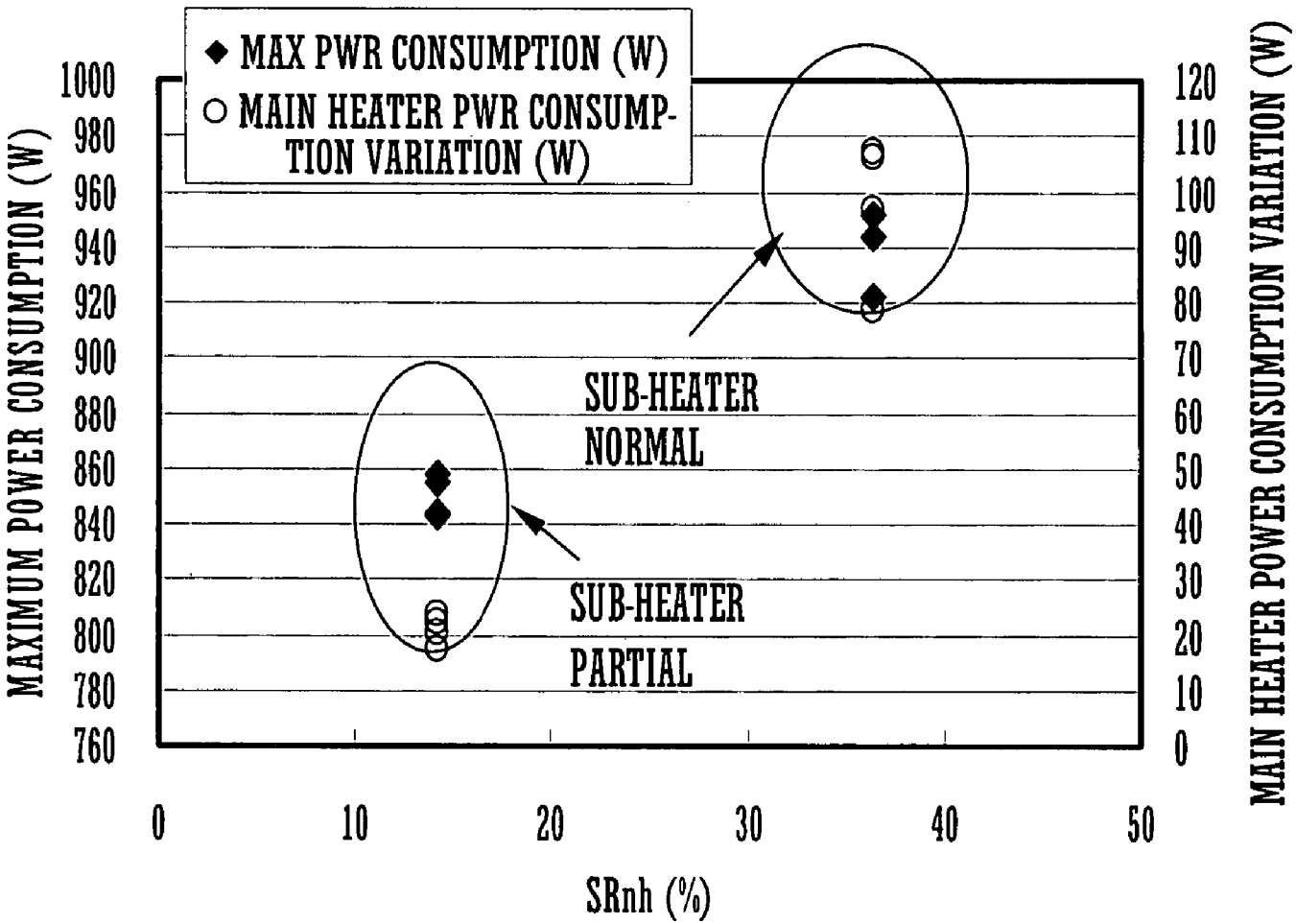
FIG. 19 is a chart showing the relationship between SRnh and the maximum power consumption and the relationship between SRnh and the power consumption of a main heater lamp.

Table 6 and FIG. 19 show the mean power consumption of each heater during passage of 100 recording sheets under each condition.

TABLE 6

| Heat Distribution | | Sheet | Mean Power Consumption (W) | | | ΔTr = A · Ln (Ht) + B | | | Main Power Consumption |
|---|---|---|---|---|---|---|---|---|---|
| Pattern | Position | Size | Main Heater | Sub Heater | Sum | Main Heater | Sub Heater | Sum | Variation (W) |
| Pattern 1 | Regular | A4 | 580.8 | 246.8 | 827.6 | 645.9 | 276.4 | 922.3 | 78.7 |
| Main: Normal A | Max Deviation | A4 | 567.2 | 276.4 | 843.7 | | | | |
| Sub: Normal | Regular | B5R | 645.9 | 0.0 | 645.9 | | | | |
| Pattern 2 | Regular | A4 | 516.1 | 307.6 | 823.8 | 604.6 | 347.1 | 951.7 | 107.2 |
| Main: Normal B | Max Deviation | A4 | 497.4 | 347.1 | 844.5 | | | | |
| Sub: Normal | Regular | B5R | 604.6 | 0.0 | 604.6 | | | | |
| Pattern 3 | Regular | A4 | 498.1 | 316.7 | 814.8 | 588.1 | 355.8 | 943.9 | 106.4 |
| Main: Normal C | Max Deviation | A4 | 481.7 | 355.8 | 837.5 | | | | |
| Sub: Normal | Regular | B5R | 588.1 | 0.0 | 588.1 | | | | |
| Pattern 4 | Regular | A4 | 628.4 | 193.1 | 821.5 | 628.4 | 226.5 | 854.8 | 23.8 |
| Main: Normal B | Max Deviation | A4 | 624.5 | 226.5 | 850.9 | | | | |
| Sub: Partial | Regular | B5R | 604.6 | 0.0 | 604.6 | | | | |
| Pattern 5 | Regular | A4 | 396.4 | 426.9 | 823.4 | 481.3 | 462.7 | 944.0 | 96.6 |
| Main: Partial A | Max Deviation | A4 | 384.7 | 462.7 | 847.4 | | | | |
| Sub: Normal | Regular | B5R | 481.3 | 96.5 | 577.9 | | | | |
| Pattern 6 | Regular | A4 | 610.4 | 200.1 | 810.5 | 610.4 | 233.6 | 844.1 | 22.4 |
| Main: Normal C | Max Deviation | A4 | 608.7 | 233.6 | 842.3 | | | | |
| Sub: Partial | Regular | B5R | 588.1 | 0.0 | 588.1 | | | | |
| Pattern 7 | Regular | A4 | 591.1 | 212.3 | 803.4 | 591.1 | 251.7 | 842.8 | 20.2 |
| Main: Partial B | Max Deviation | A4 | 586.9 | 251.7 | 838.5 | | | | |
| Sub: Partial | Regular | B5R | 570.9 | 0.0 | 570.9 | | | | |
| Pattern 8 | Regular | A4 | 527.3 | 292.4 | 819.7 | 528.1 | 329.6 | 857.7 | 17.2 |
| Main: Partial A | Max Deviation | A4 | 528.1 | 329.6 | 857.7 | | | | |
| Sub: Partial | Regular | B5R | 510.9 | 66.3 | 577.2 | | | | |

As can be seen from Table 6 and FIG. 19, the main heater lamp 234*a*, for example, in pattern 1 consumed:

580.8 W under the condition (1);

567.2 W under the condition (2); and 645.9 W under the condition (3), and the sub-heater lamp 235*a* consumed:

246.8 W under the condition (1);

276.4 W under the condition (2); and

0 W under the condition (3).

Thus, the maximum power consumption of the main heater lamp 234*a* was 645.9 W under the condition (3), the maximum power consumption of the sub-heater lamp 235*a* was 276.4 W under the condition (2), and the sum total of the maximum power consumptions was 922.3 W. The variation in the mean power consumption of the main heater lamp 234*a* under the three conditions was 645.9−567.2=78.7 W.

According to comparison of the heat distribution patterns as to maximum power consumption and variation in the power consumption of the main heater lamp 234*a*, the patterns each using the partial heater for the sub-heater lamp 235*a* (patterns 4, 6, 7 and 8) were lower by about 100 W in maximum power consumption than other patterns each using the normal lamp for the sub-heater lamp 235*a*.

When the normal lamp is used for the sub-heater lamp 235*a*, the central portion (M) of the fixing roller is supplied with heat from both of the main heater lamp 234*a* and the sub-heater lamp 235*a* during passage of A4-size recording sheets because the normal-type sub-heater lamp 235*a* distributes some heat even in a central portion along the fixing roller axis. However, small-sized sheets such as B5R-size sheets are supplied with heat from the main heater lamp 234*a* only and, therefore, the power consumption of the main heater 234*a* during passage of B5R-size sheets is larger than in the case of A4-size sheets.

As a result, the variation in the power consumption of the main heater lamp 234*a* also increases to 78.7–107.2 W. This means that the main heater 234*a* is operated by a power that is lower by about 100 W than the rated power during passage of A4-size sheets of which size is used most frequently. This results in problems that: the heat exchange efficiency of the heater lowers; and an apparatus of the type which requires an increased power consumption to fulfill its functions other than the fixing function and has a great limitation on the fixing rated power, such as a high-speed multifunctional machine, requires a power exceeding the rated power during passage of small-sized sheets and hence cannot ensure a satisfactory temperature follow-up capability, and in like problems.

On the other hand, when the partial lamp is used for the sub-heater lamp 235*a*, the central portion (M) of the fixing roller is supplied with heat from the main heater lamp 234*a* substantially exclusively even during passage of A4-size recording sheets because the partial-type sub-heater lamp 235*a* distributes substantially no heat in a central portion along the fixing roller axis. For this reason, the power consumption of the main heater lamp 235*a* varies little between the case of passage of A4-size sheets and the case of passage of B5R-size sheets.

As a result, the variation in the power consumption of the main heater lamp 234*a* is as very small as 17.2–23.8 W. Therefore, the main heater 234*a* can be used at a power close to the rated power, thus assuring that the heating member offers a superior heat exchange efficiency and has a satisfactory temperature follow-up capability on small-sized sheets even when used in a high-speed multifunctional machine or the like.

It can be concluded from the above-described results that use of the partial lamp for the sub-heater lamp 235*a* is preferred to that for the main heater lamp 234*a* from the viewpoint of power consumption.

Figure 21:
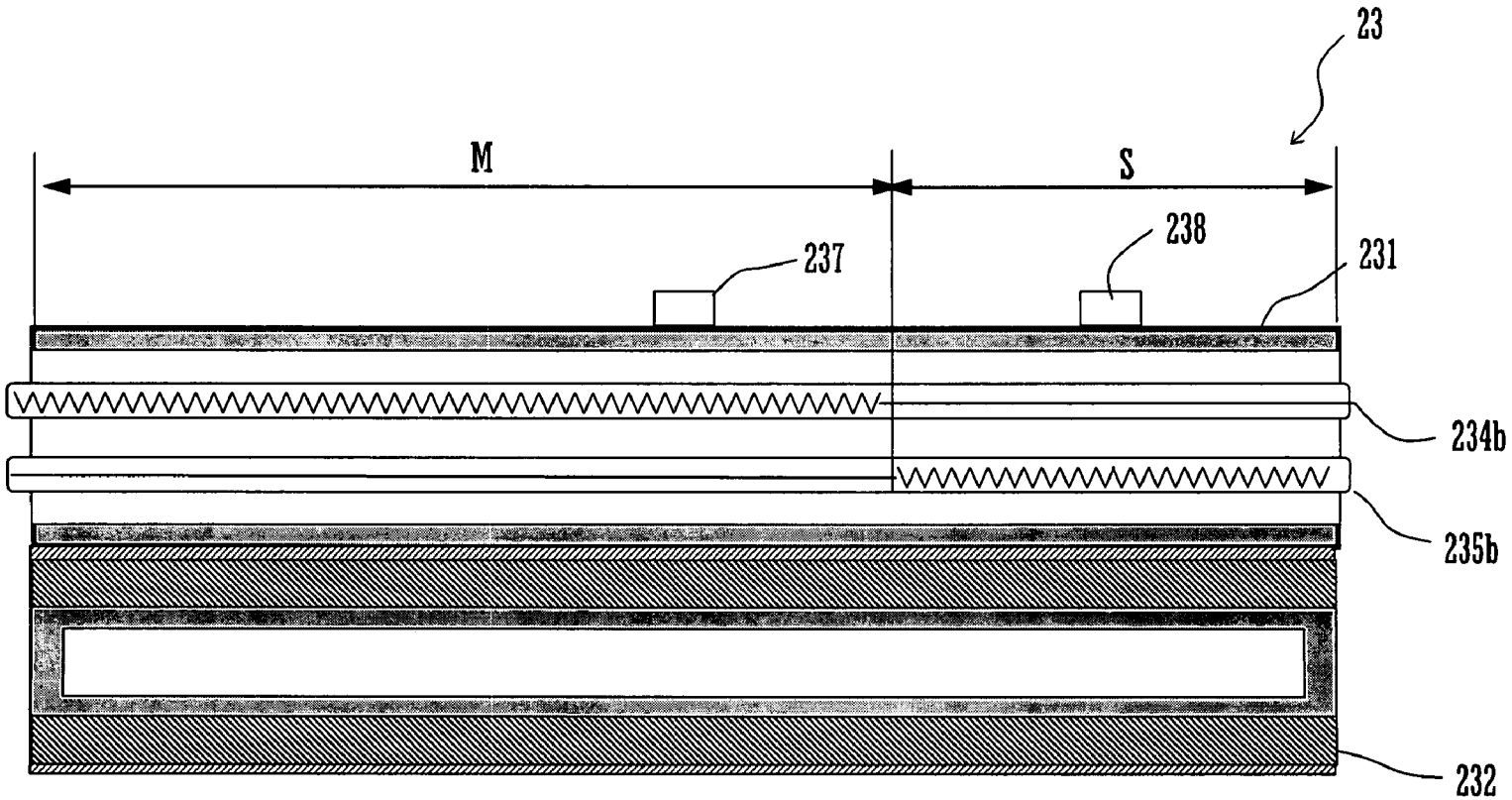
FIG. 21 is a view showing heat generating section and no-heat generating section of each heater lamp according to embodiment 2.

With reference to FIG. 21, description will be made of embodiment 2. Since embodiment 2 is the same as embodiment 1 except heat distributions of heater lamps, description of other features than the heater lamps will be omitted.

FIG. 21 is a view schematically showing the construction of a heating device of the present invention used in a fixing device of the so-called side registration type which is configured to pass recording sheets therethrough with a side position of fixing roller 231 used as a reference. This side registration type fixing device causes each recording sheet, regardless of the size thereof, to pass therethrough with its one widthwise edge aligned with one axial end (left-hand end in the figure) of the fixing roller 231. Even in this embodiment 2, the heat generating (light emitting) section of a main heater lamp 234*b* is positioned to face a central portion of each recording sheet.

The main heater lamp 234*b* and sub-heater lamp 235*b* are configured to heat a small-sized sheet passage region M and a region S, respectively, of the fixing roller 231 which extend axially of the fixing roller 231. The small-sized sheet passage region M extends from one-axial end of the fixing roller 231 and the region S is a part of a maximum sheet passage region (M+S) other than the small-sized sheet passage region M. The main heater lamp 234*b* has a no-heat generating section formed to be continuous with the heat generating section thereof and, similarly, the sub-heater lamp 235*b* has a no-heat generating section formed to be continuous with a heat generating section thereof. The heat generating section of the sub-heater lamp 235*b* is opposed to the no-heat generating section of the main heater lamp 234*b*, while the no-heat generating section of the sub-heater lamp 235*b* opposed to the heat generating section of the main heater lamp 234*b*.

A total of two thermistors are provided as the temperature sensors; one thermistor 237 is disposed in the heat generating section M of the main heater 234*b* and the other thermistor 238 disposed in the heat generating section S2 of the sub-heater lamp 235*b*. A signal detected by each thermistor is inputted to a non-illustrated control section comprising a CPU. The control section is configured to control current passing through each heater by means of a non-illustrated driver based on the fixing roller surface temperature detected. That is, the control section controls the main heater lamp 234*b* based on the output of the thermistor 237 and the sub-heater lamp 235*a* based on the output of the thermistor 238 individually and independently.

The main heater lamp 234*b* is of the type so-called normal lamp having a no-heat generating section in which the mean value MRnh of heat distribution (relative value) is 35.9%, while the sub-heater lamp 235*b* is of the type so-called partial lamp having a no-heat generating section in which the mean value SRnh of heat distribution (relative value) is 14.2%.

By thus establishing the heat distributions of the main heater lamp 234*b* and sub-heater lamp 235*b*, it becomes possible to reduce the temperature variation ΔTr along the fixing roller axis due to a positional deviation of heat distribution or passage of small-sized sheets to 25 deg or less as well as to suppress the maximum power consumption, the variation in the power of the main heater lamp 234*b*, and the like even in the side registration type fixing device, as in embodiment 1.

Figure 22:
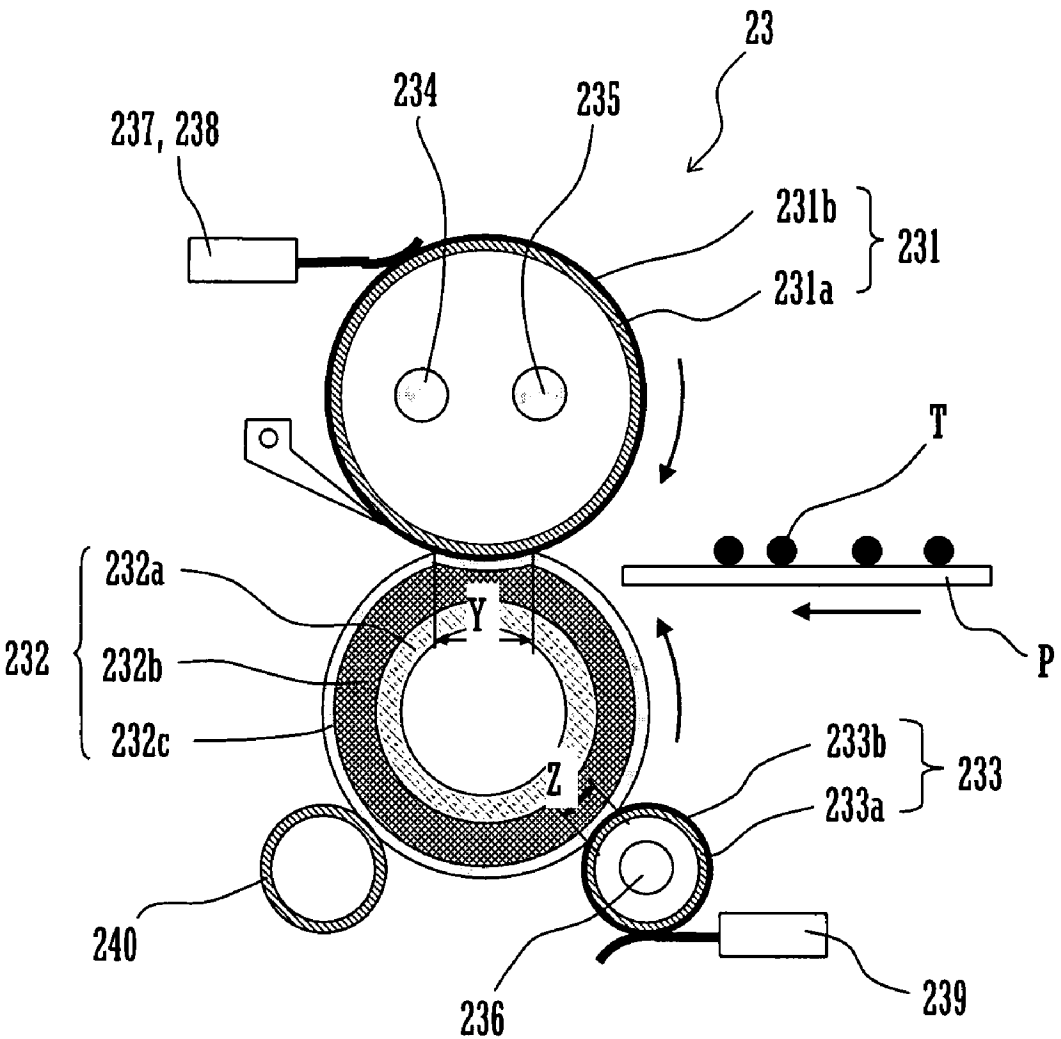
FIG. 22 is an explanatory view showing the construction of a fixing device according to embodiment 3.
Figure 23:
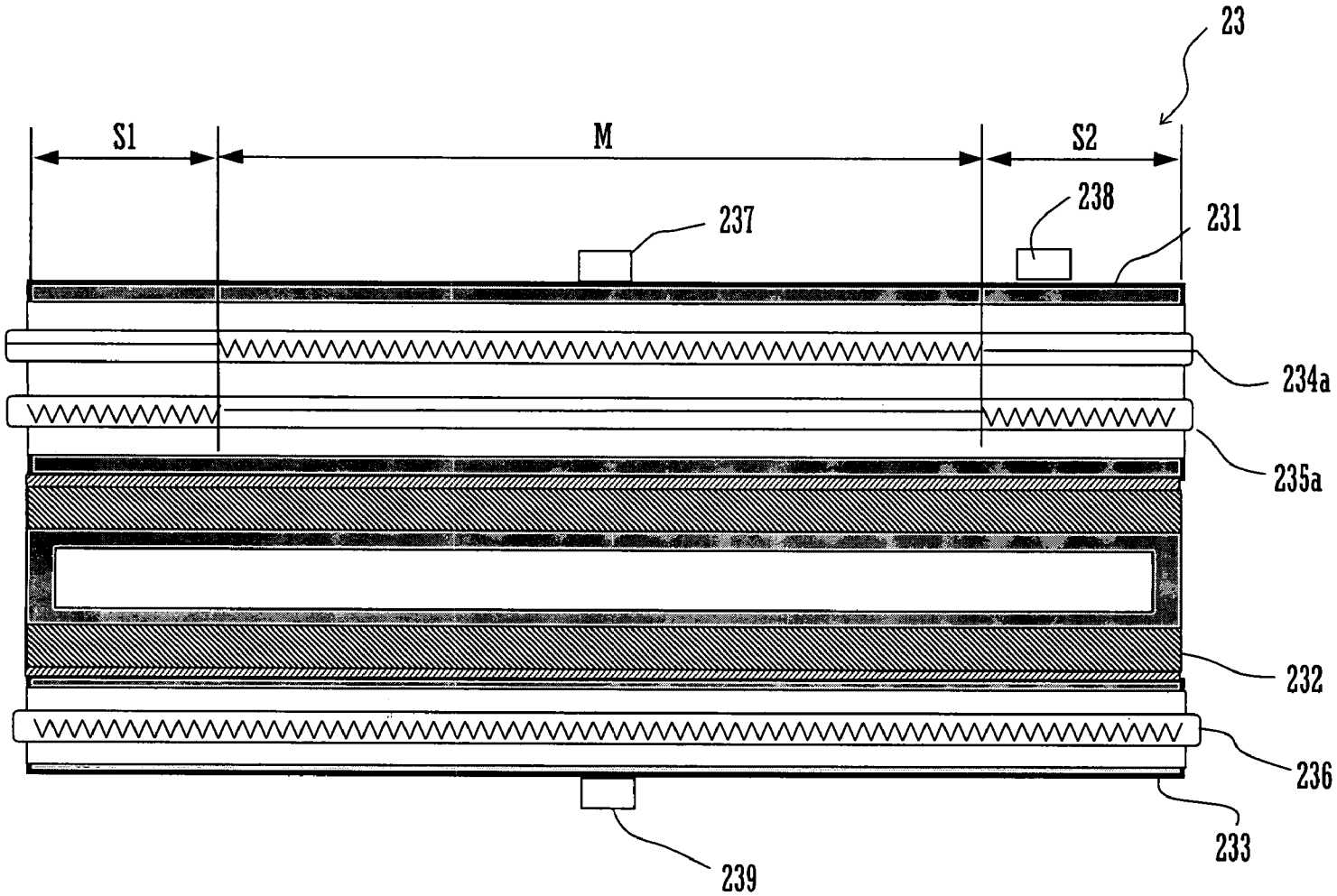
FIG. 23 is a view showing heat generating section and no-heat generating section of each heater lamp according to embodiment 3.
Figure 24:
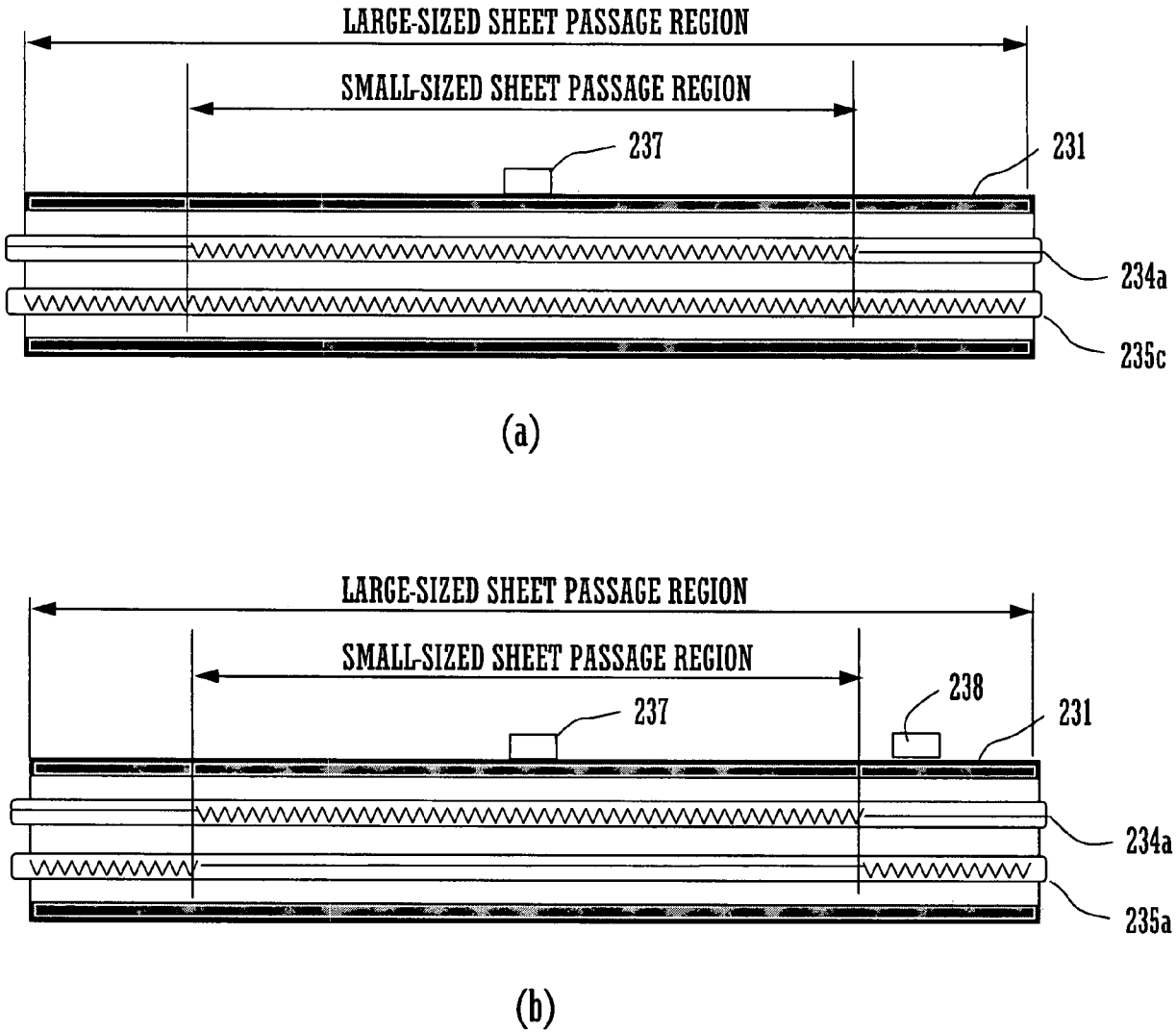
FIG. 24 is an explanatory view showing the construction of a conventional fixing device having plural heater lamps.

With reference to FIGS. 22 and 23, description will be made of embodiment 3 of the present invention. Since this embodiment is the same as embodiment 1 except that an external heating roller is additionally provided on the pressurizing roller side, description of other features than the external heating roller will be omitted. FIGS. 22 and 23 schematically show the construction of a fixing device of the external heating type to which the present invention is applied.

As shown in these figures, the fixing device 23 includes a fixing roller 231 as an upper heating member, a pressurizing roller 232 as a lower heating member, an external heating roller 233 as external heating means, heater lamps 234, 235 and 236 as heat sources for the fixing roller 231 and the external heating roller 233, temperature sensors 237, 238 and 239 forming temperature detection means for detecting the temperatures of respective of the fixing roller 231 and the external heating roller 233, a cleaning roller 240, and a control circuit (not shown) as temperature control means.

The main heater lamp 234*a* is of the type so-called normal lamp having a no-heat generating section in which the mean value MRnh of heat distribution (relative value) is 35.9%, while the sub-heater lamp 235*a* is of the type so-called partial lamp having a no-heat generating section in which the mean value SRnh of heat distribution (relative value) is 14.2%.

The heater lamp 236, which comprises a halogen heater, is disposed within the external heating roller 233. When energized by the control circuit, the heater lamp 236 generates heat to provide a predetermined heat distribution, so that the inner peripheral surface of the external heating roller 233 is heated by irradiation with infrared rays. (In the present embodiment the heat generating section of the external heater covers the entire region of the external heating roller.)

The external heating roller 233 having the heater lamp 236 as a heating source therewithin is positioned upstream of the fixing nip zone and configured to press against the pressurizing roller 232 with a predetermined pressing force. The external heating roller 233 and the pressurizing roller 232 define therebetween a heating nip zone Z (having a heating nip width of 1 mm in this embodiment).

The external heating roller comprises a hollow cylindrical metal core 233*a* of aluminum, iron material or the like, and a heat-resistant release layer 233*b* comprising a synthetic resin material that is excellent in heat resistance and release characteristics, for example, elastomer such as silicone rubber or fluororubber, or fluororesin such as PFA or PTFE.

The present embodiment uses a cylindrical shaft of aluminum having a diameter of 15 mm and a wall thickness of 0.75 mm as the core 233*a*. The heat-resistant release material forming the heat-resistant release layer 233*b* comprises a 25 μm-thick baked coat formed of a blend of PFA and PTFE. The rated output of the heater lamp 236 is 300 W.

Thermistors 234, 235 and 236 are provided on the peripheral surfaces of respective of the fixing roller and the external heating roller as temperature detection means for detecting the surface temperature of each roller. Based on temperature data detected by each of the thermistors, temperature control means (not shown) controls current passing through each of the heater lamps 234, 235 and 236 so that the temperature of each roller is held at a predetermined temperature (190° C. in this embodiment).

By thus establishing the heat distributions of the main heater lamp 234*a* and sub-heater lamp 235*a* as in embodiment 1, it becomes possible to reduce the fixing roller temperature variation ΔTr due to a positional deviation of heat distribution of the main heater lamp 234*a* or passage of small-sized sheets to 25 deg or less as well as to suppress the maximum power consumption, the variation in the power of the main heater lamp 234*a*, and the like even in the fixing device having the external heating roller.

It should be noted here that since the external heater 236 is not a heater having a heat generating section and a no-heat generating section both, only the main heater lamp 234*a* and the sub-heater lamp 235*a* are taken into account with the external heater 236 precluded in the calculation of ΣRnh.

While any one of the foregoing embodiments comprises a combination of one main heater lamp 234 and one sub-heater lamp 235, it is needless to say that the present invention is applicable to a combination of one main heater lamp 234 and plural sub-heater lamps for example.

Specifically, in the case of a fixing device including one main heater lamp 234 and two sub-heater lamps 235, assuming that: the mean value of heat distribution (relative value) in a no-heat generating section of the main heater lamp 234 is MRnh(%); the mean value of heat distribution (relative value) in a no-heat generating section of the sub-heater lamp 1 is SRnh1(%); and the mean value of heat distribution (relative value) in a no-heat generating section of the sub-heater lamp 2 is SRnh2(%), the formula (10) holds.

$$\Sigma Rnh = MRnh + SRnh \qquad \text{formula (10)}$$

where SRnh=SRnh1+SRnh2.

The heat distributions of respective of the main heater lamp 234 and the two sub-heater lamps 235 are simply established so that the formula (10) holds while at the same time the formulae (1) and (2) hold as in the foregoing embodiments.

It should be noted that the present invention does not limit the image forming apparatus to the construction shown in FIG. 1 and is applicable to any image forming apparatus which comprises, at least, sheet feeding means for feeding recording sheets, an image forming section for forming an image on each of the recording sheets fed from the sheet feeding means based on image data, and a heating device configured to heat and fix the image formed on the recording sheet.

The invention claimed is:

1. A heating device comprising:

a cylindrical heating member configured to heat and fix a toner image carried on a recording sheet brought into contact with a periphery of the heating member by rotation;

a first heating unit disposed within the heating member and having a first heat generating section including a heating generating portion facing a central portion of the recording sheet, and a first no-heat generating section continuous with the first heat generating section; and a second heating unit disposed within the heating member and having a second no-heat generating section opposed to the first heat generating section, and a second heat generating section opposed to the first no-heat generating section, wherein MRnh, SRnh and ΣRnh satisfy the formula (1):

$$\Sigma Rnh \geqq 30.5 \cdot Ln(Ht) + 382 \qquad \text{formula (1),}$$

where MRnh is a mean value of heat distribution in the first no-heat generating section of the first heating unit; SRnh is a mean value of heat distribution in the second no-heat generating section of the second heating unit; ΣRnh (=MRnh+SRnh) is the sum total of the mean value of heat distribution in the first no-heat generation section and the mean value of heat distribution in the second no-heat generating section; and Ht=vp/(Mh·λ) where vp is a fixing speed (m/s), Mh a heat capacity per unit length of the heating member (J/(° C.·m)) and λ a heat conductivity of a material forming the heating member (W/(m·° C.)).

2. The heating device according to claim 1, wherein the mean value SRnh satisfies the formula (3):

$$SRnh \leqq 20\% \qquad \text{formula (3).}$$

3. The heating device according to claim 2, wherein the second no-heat generating section of the second heating unit includes a filament coil into which a shortcircuiting stem is inserted.

4. The heating device according to claim 1, wherein the heating member is a heating roller comprising a cylindrical core coated with a coat layer, the core being formed from an iron material.

5. A heating device comprising:

a cylindrical heating member configured to heat and fix a toner image carried on a recording sheet brought into contact with a periphery of the heating member by rotation;

a first heating unit disposed within the heating member and having a first heat generating section including a heating generating portion facing a central portion of the recording sheet, and a first no-heat generating section continuous with the first heat generating section; and a second heating unit disposed within the heating member and having a second no-heat generating section opposed to the first heat generating section, and a second heat generating section opposed to the first no-heat generating section, wherein MRnh satisfies the formula (2):

$$MRnh \leqq -21.9 \cdot Ln(Ht) - 198 \qquad \text{formula (2),}$$

where MRnh is a mean value of heat distribution in the first no-heat generating section of the first heating unit; and Ht=vp/(Mh·λ) where vp is a fixing speed (m/s), Mh a heat capacity per unit length of the heating member (J/(° C.·m)) and λ a heat conductivity of a material forming the heating member (W/(m·° C.)).

6. A heating device comprising:

a cylindrical heating member configured to heat and fix a toner image carried on a recording sheet brought into contact with a periphery of the heating member by rotation;

a first heating unit disposed within the heating member and having a first heat generating section including a heating generating portion facing a central portion of the recording sheet, and a first no-heat generating section continuous with the first heat generating section; and a second heating unit disposed within the heating member and having a second no-heat generating section opposed to the first heat generating section, and a second heat generating section opposed to the first no-heat generating section, wherein MRnh, SRnh and ΣRnh satisfy the formulae (1) and (2):

$$\Sigma Rnh \geqq 30.5 \cdot Ln(Ht) + 382 \quad \text{formula (1)}$$

$$MRnh \leqq -21.9 \cdot Ln(Ht) - 198 \quad \text{formula (2),}$$

where MRnh is a mean value of heat distribution in the first no-heat generating section of the first heating unit; SRnh is a mean value of heat distribution in the second no-heat generating section of the second heating unit; ΣRnh (=MRnh+SRnh) is the sum total of the mean value of heat distribution in the first no-heat generation section and the mean value of heat distribution in the second no-heat generating section; and Ht=vp/(Mh·λ) where vp is a fixing speed (m/s), Mh a heat capacity per unit length of the heating member (J/(° C.·m)) and λ a heat conductivity of a material forming the heating member (W/(m·° C.)).

7. The heating device according to claim 6, which satisfies the formula (4):

$$Ht \geqq 7.74 \times 10^{-6} \quad \text{formula (4).}$$

8. An image forming apparatus comprising:

sheet feeding means for feeding recording sheets;

an image forming section for forming an image on a recording sheet fed from the sheet feeding means based on image data; and a heating device configured to heat and fix the image formed on the recording sheet, the heating device including:

a cylindrical heating member configured to heat and fix a toner image carried on a recording sheet brought into contact with a periphery of the heating member by rotation;

a first heating unit disposed within the heating member and having a first heat generating section including a heating generating portion facing a central portion of the recording sheet, and a first no-heat generating section continuous with the first heat generating section; and a second heating unit disposed within the heating member and having a second no-heat generating section opposed to the first heat generating section, and a second heat generating section opposed to the first no-heat generating section, wherein MRnh, SRnh and ΣRnh satisfy the formula (1):

$$\Sigma Rnh \geqq 30.5 \cdot Ln(Ht) + 382 \quad \text{formula (1),}$$

where MRnh is a mean value of heat distribution in the first no-heat generating section of the first heating unit; SRnh is a mean value of heat distribution in the second no-heat generating section of the second heating unit; ΣRnh (=MRnh+SRnh) is the sum total of the mean value of heat distribution in the first no-heat generation section and the mean value of heat distribution in the second no-heat generating section; and Ht=vp/(Mh·λ) where vp is a fixing speed (m/s), Mh a heat capacity per unit length of the heating member (J/(° C.·m)) and λ a heat conductivity of a material forming the heating member (W/·(m·° C.)).

* * * * *